US007208668B2

(12) United States Patent
Shimoda

(10) Patent No.: US 7,208,668 B2
(45) Date of Patent: Apr. 24, 2007

(54) KEYBOARD DEVICE FOR KEYBOARD INSTRUMENT

(75) Inventor: Yoshiaki Shimoda, Shizuoka-ken (JP)

(73) Assignee: Kabushiki Kaisha Kawai Gakki Seisakusho, Shizuoka-ken (JP)

( * ) Notice: Subject to any disclaimer, the term of this patent is extended or adjusted under 35 U.S.C. 154(b) by 516 days.

(21) Appl. No.: 10/849,216

(22) Filed: May 20, 2004

(65) Prior Publication Data

US 2005/0011330 A1 Jan. 20, 2005

(30) Foreign Application Priority Data

Jul. 15, 2003 (JP) ..... 2003-197447
Aug. 27, 2003 (JP) ..... 2003-303084

(51) Int. Cl.
*G10C 3/12* (2006.01)

(52) U.S. Cl. ..... 84/434

(58) Field of Classification Search ..... 84/423 R, 84/424, 425, 432, 434–436
See application file for complete search history.

(56) References Cited

U.S. PATENT DOCUMENTS 5,610,352 A * 3/1997 Yamaguchi ..... 84/435
5,824,928 A * 10/1998 Kumano et al. ..... 84/423 R
5,929,357 A * 7/1999 Masubuchi ..... 84/423 R
6,147,290 A * 11/2000 Uno ..... 84/433
6,156,963 A * 12/2000 Masubuchi et al. ..... 84/423 R
6,191,351 B1 * 2/2001 Niitsuma ..... 84/720
6,369,309 B1 * 4/2002 Nishida ..... 84/423 R
2004/0065186 A1 * 4/2004 Yamaguchi ..... 84/423 R
2004/0261598 A1 * 12/2004 Uno et al. ..... 84/235

* cited by examiner

*Primary Examiner*—Ross Gushi
(74) *Attorney, Agent, or Firm*—Crowell & Moring LLP

(57) ABSTRACT

A keyboard instrument which is capable of ensuring sufficient strength of neighboring portions of chassis and preventing generation of noise, while restricting lateral motion of hammers. Keys are pivotally supported by chassis arranged side by side in a left-right direction. Hammers are pivotally supported by the chassis, for each being pivotally moved in accordance with depression of the associated key. Guides are formed in the chassis and each have a pair of left and right sidewalls opposed to the associated hammer from opposite sides, for restricting lateral motion of the associated hammer. Out of the guides, one at a boundary of each adjacent two of the chassis has the pair of sidewalls formed by an end sidewall of one of the adjacent two chassis and an end sidewall of the other of the same.

12 Claims, 18 Drawing Sheets

KEYBOARD DEVICE FOR KEYBOARD INSTRUMENT

BACKGROUND OF THE INVENTION

1. Field of the Invention

This invention relates to a keyboard device for a keyboard instrument, such as an electronic piano.

2. Description of the Prior Art

Conventionally, this kind of keyboard device has been proposed e.g. in Japanese Laid-Open Patent Publication (Kokai) No. 2000-122654. This keyboard device is for use in an electronic piano, and as shown in FIG. 15, it includes a chassis assembly 81, a plurality of keys 82 (only one of which is shown) and a plurality of hammers 83 (only one of which is shown). The chassis assembly 81 is comprised of six intermediate chassis 81*a* (see FIG. 16) each provided as a unit for one octave, a chassis (not shown) for the lowest pitch range, and a chassis (not shown) for the highest pitch range, which are formed by injection molding of a synthetic resin, such as an ABS resin. The intermediate chassis 81*a* are identical in size and shape. These eight chassis are connected by four connecting bars 91 extending in the left-right direction, such that they are arranged side by side in the left-right direction, and supported on a keybed 84. Each of the chassis has key supports 85 formed at a rear end thereof, hammer supports 86 formed at a central portion thereof, second hammer passage holes 87 formed through respective portions forward of the hammer supports 86, and first hammer passage holes 88 formed through a front end thereof (see FIG. 16). The key supports 85, the hammer supports 86, the second hammer passage holes 87, and the first hammer passage holes 88 are formed in association with the respective keys 82. Each adjacent two of the first hammer passage holes 88 are separated by a sidewall 90.

The keys 82 are comprised of white keys 82*a* and black keys 82*b*. Each of the keys 82 has a rear end thereof pivotally supported by the associated key support 85 of the chassis assembly 81, and extends in the front-rear direction on the upper side of the chassis assembly 81. Each hammer 83 also extends in the front-rear direction, and the rear end thereof is mounted to two adjacent hammer supports 86 and 86 in a manner spanning these, and pivotally supported by them. Further, the hammer 83 passes through the associated second hammer passage hole 87 and extends forward below the chassis assembly 81. The hammer 83 has weight plates 89 (only one of which is shown) attached to the respective left and right side surfaces of the front end thereof, for adding weight to the hammer 83. Above the front end of the hammer 83, there opens the associated first hammer passage hole 88.

Fixed to the four connecting bars 91 connecting the chassis are ribs 92 (only one of which is shown) for reinforcing the rigidity of the chassis assembly 81 in the front-rear direction, which are arranged at respective predetermined locations on an octave-by-octave basis in a manner spanning the connecting bars 91. The ribs 92 are each formed e.g. of a single steel plate, and extend below the associated sidewall 90 over substantially the entire length of the chassis assembly 81 in the front-rear direction such the ribs 92 do not come into contact with the hammers 83.

With the arrangement described above, as a key 82 is depressed, the rear end of the associated hammer 83 is pressed downward by the key 82, whereby the hammer 83 is pivoted clockwise, as viewed in FIG. 15, about the hammer supports 86. In accordance with the pivotal motion, the front end of the hammer 83 passes through the first hammer passage hole 88 from below.

In the above-described conventional keyboard device, the hammer 83 has the rear end thereof supported by the hammer supports 86, with the front end thereof being freely movable in the left-right direction. For this reason, when the electronic piano is stored in a vertically placed position in which the lateral sides thereof are turned into the respective top and bottom sides thereof, the hammer 83 largely hangs down from the hammer supports 86, and there acts large bending moment caused by the weight of the hammer itself including the weight plates 89 positioned remote from the hammer supports 86, so that there is a fear of the hammer 83 being deformed. If the hammer 83 is deformed, when the electronic piano is played in its horizontal or normal position, the hammer 83 passing through the first hammer passage hole 88 can come into contact with the sidewall 90 of the first hammer passage hole 88, thereby hindering the musical performance.

To eliminate the above-described inconvenience, a method can be contemplated in which the left and right sidewalls 90 of each first hammer passage hole 88 are extended downward, as shown in FIGS. 17 and 18, and fixed on the keybed 84, for example, for restriction of the lateral motion of the hammer 83. In this case however, as shown in FIG. 18, to make the distance between the respective adjacent first hammer passage holes 88 and 88 of the opposed boundary portions of the intermediate chassis 81*a* and 81*a* equal to the distance between those of the other portions, it is required to make the respective adjacent outermost sidewalls 90*a* and 90*a* of the two boundary portions thinner than those of the other portions, so that the strength of the sidewalls 90*a* and 90*a* is reduced. Further, since the outermost sidewalls 90*a* are thin and wider than the conventional ones, the sidewalls 90*a* and 90*a* are liable to undergo vibrations e.g. by contact with the associated hammers 83, which can cause undesired noise. To eliminate this inconvenience, if the intermediate chassis 81*a* and 81*a* are bonded to each other, this increases the number of manufacturing steps, which increases the manufacturing costs, and makes it difficult to disassemble the chassis assembly 81.

Further, since the sidewalls 90 are extended to the keybed 84, there is no space for arranging the ribs 92, and hence it is impossible to attach the ribs 92 to the chassis assembly 81. As a result, the rigidity of the chassis assembly 81 in the front-rear direction is reduced, so that there is a fear of the chassis assembly 81 being bent e.g. due to the weight of the hammers 83, thereby hindering a musical performance. To solve this problem, it can be considered that the ribs 92 or other reinforcing members are provided at locations other than the locations below the sidewalls 90 so as to reinforce the chassis assembly 81, but in this case, there is a problem of the keyboard device being inevitably increased in size.

SUMMARY OF THE INVENTION

It is a first object of the present invention to provide a keyboard device for a keyboard instrument, which is capable of ensuring sufficient strength of boundary portions of chassis and preventing generation of noise, while restricting lateral motion of hammers.

It is a second object of the present invention to provide a keyboard device for a keyboard instrument, which is capable of sufficiently reinforcing the rigidity of chassis in the front-rear direction while restricting lateral motion of hammers, without increasing the size of the keyboard device.

To attain the first object, in a first aspect of the present invention, there is provided a keyboard device for a keyboard instrument, comprising:

a plurality of chassis arranged side by side in a left-right direction;

a plurality of keys pivotally supported by the chassis;

a plurality of hammers pivotally supported by the chassis, for each being pivotally moved in accordance with depression of an associated one of the keys; and a plurality of guides formed in the chassis and each having a pair of left and right sidewalls which are opposed to an associated one of the hammers from opposite sides, for restricting lateral motion of the associated one of the hammers, wherein out of the plurality of guides, one at a boundary of each adjacent two of the chassis has the pair of left and right sidewalls formed by an end sidewall of one of the adjacent two chassis and an end sidewall of the other of the adjacent two chassis.

With the arrangement of the keyboard device according to the first aspect of the present invention, even when the keyboard instrument is placed vertically e.g. for storage, the hammer attempting to hang down in a vertical direction (corresponding to a horizontal direction when the keyboard instrument is in a normal or horizontally placed position) due to its own weight abuts against the lower one of the sidewalls of the guide closely opposed to the hammer, whereby the further downward motion of the hammer is prevented. Thus, the hammer is supported by the sidewall without hardly hanging down, so that bending moment acting on the hammer due to its own weight is reduced, which makes it possible to prevent deformation of the hammer. As a consequence, musical performance on the electronic piano can be carried out without inconvenience when the keyboard instrument is in normal position.

Further, the pair of sidewalls of a guide at the boundary of the adjacent chassis are formed by an end sidewall of one of the chassis and an end sidewall of the other of the same. Therefore, it is possible to secure the same thickness for each of the sidewalls as that of the sidewalls at the other locations than the boundary. This makes it possible to ensure sufficient strength of the guide at the boundary similarly to the other guides. Further, the increased thickness of the sidewalls at the boundary makes the sidewalls difficult to vibrate, which makes it possible to prevent noise from being generated when the hammer is brought into contact with the sidewalls.

Preferably, the plurality of chassis include a plurality of chassis which are identical to each other and each provided as a unit for one octave.

In the keyboard instrument, white keys and black keys are in the same arrangement, and this arrangement is repeated on an octave-by-octave basis. Therefore, with the arrangement of this preferred embodiment, most of chassis can be formed by a plurality of chassis which are identical to each other and each provided as a unit for one octave, so that it is possible to reduce the cost of molds by using the common mold therefor. As a consequence, it is possible to largely reduce the manufacturing costs of chassis, and hence the manufacturing costs of the keyboard device.

Preferably, the guides are integrally formed with the chassis.

With the arrangement of this preferred embodiment, the operation of mounting the guides to the chassis can be dispensed with, which makes it possible to reduce the manufacturing costs of the keyboard device.

More preferably, the chassis are formed by molded articles of a synthetic resin.

With the arrangement of this preferred embodiment, it is possible to easily manufacture the chassis having a desired shape, a strength characteristic without undesired variation, and so forth.

To attain the second object, in a second aspect of the present invention, there is provided a keyboard device for a keyboard instrument, comprising:

a plurality of chassis arranged side by side in a left-right direction;

a plurality of keys pivotally supported by the chassis;

a plurality of hammers arranged side by side in the left-right direction, and pivotally supported by the chassis, for being pivotally moved in accordance with depression of an associated one of the keys; and a plurality of sidewalls formed in the chassis such that the sidewalls are arranged side by side in the left-right direction at predetermined spaced intervals, each adjacent two of the sidewalls restricting lateral motion of an associated one of the hammers, wherein at least one of the plurality of sidewalls is removed from each of the chassis, and wherein the each chassis has a rib mounted therein such that the rib extends in a front-rear direction through a location where the at least one of the plurality of sidewalls is removed, for reinforcing the each chassis as well as for cooperating with two of the sidewalls located leftward and rightward of the rib to restrict lateral motion of an associated one of the hammers.

With the arrangement of the keyboard device for a keyboard instrument, according to the second aspect of the present invention, each chassis is formed with a plurality of sidewalls arranged side by side in the left-right direction, and each adjacent two of the sidewalls restricts lateral motion of an associated one of the hammers. As a result, in a case where the keyboard instrument is placed vertically e.g. for storage, the hammer attempting to hang down in a vertical direction (corresponding to a horizontal direction when the keyboard instrument is in a normal or horizontally placed position) due to its own weight abuts against the lower sidewall, whereby further downward motion of the hammer is prevented. Thus, the hammer is supported by the sidewall without hardly hanging down, so that bending moment acting on the hammer due to its own weight is reduced, which makes it possible to prevent deformation of the hammer. As a consequence, musical performance on the keyboard instrument can be carried out without inconvenience when the electronic keyboard is in normal position.

Further, since at least one of the sidewalls is removed from the chassis, and a rib extending in the front-rear direction is mounted where the sidewall is removed, it is possible to reinforce the rigidity of the chassis in the front-rear direction by the rib. Therefore, there is no need to secure new space for mounting the rib, which makes it possible to prevent the size of the keyboard device from being increased.

Moreover, the rib not only reinforces the rigidity of the chassis, but also cooperates, in place of the removed sidewall, with the sidewalls formed leftward and rightward thereof to restrict the lateral motion of the associated hammer. Since the rib has both the functions of reinforcing the chassis and serving as a sidewall as described above, the number of component parts can be reduced, which contributes to reduction of the manufacturing costs of the keyboard device.

Preferably, the chassis are formed by molded articles of a synthetic resin, with which the plurality of sidewalls are integrally formed, and the rib is formed of a metal.

With the arrangement of this preferred embodiment, the chassis are formed by molded articles of a synthetic resin, and therefore it is possible to easily produce chassis having a desired shape and a strength characteristic without undesired variation. Further, since the sidewalls are integrally formed with the chassis, the operation of mounting the sidewalls on the chassis can be dispensed with, which contributes to reduction of the manufacturing costs of the keyboard device. Furthermore, since the rigidity of the chassis is sufficiently reinforced by the metal rib, even when a large force is applied to the chassis from the key or the hammer, it is possible to prevent distortion of the chassis by the rib. As a consequence, musical performance on the keyboard instrument can be carried out without inconvenience.

More preferably, each of the sidewalls has left and right side surfaces thereof integrally formed with respective guide protrusions extending vertically, and the rib has guide protrusion members attached to left and right side surfaces thereof at respective locations corresponding to the guide protrusions, the guide protrusion members being formed of a synthetic resin and extending vertically.

With the arrangement of this preferred embodiment, even if the hammer laterally moves out of its proper path of motion during musical performance, the hammer comes into contact with only the guide protrusion or the guide protrusion member, which extends vertically and is formed of a synthetic resin, so that an area with which the hammer comes into contact is smaller and hence friction due to the contact is also smaller than when the hammer comes into contact with the sidewall or the side surface of the rib, which makes it possible to prevent degradation of the touch feeling of the key and generation of noise. In particular, since the hammer is prevented from being brought into contact with the rib formed of a metal or the like, generation of metallic sound can be prevented. Further, since the guide protrusions are integrally formed with the respective left and right side surfaces of the sidewall, the operation of attaching the guide protrusions to the sidewalls can be dispensed with, which contributes to reduction of manufacturing costs. Furthermore, since the guide protrusion members are formed of a synthetic resin similarly to the guide protrusions, each guide protrusion member can cooperate with the associated guide protrusion to guide the hammer in a well-balanced manner and prevent the same from being unevenly worn.

Preferably, the plurality of chassis include a plurality of basic chassis which are identical to each other and each provided as a unit for one octave, and the rib is mounted at a predetermined identical location of each of the plurality of basic chassis.

With the arrangement of this preferred embodiment, most of the chassis can be formed by a plurality of basic chassis which are identical to each other and each provided as a unit for one octave. Further, since the rib is mounted at an identical location of each of the plurality of basic chassis, locations of sidewalls to be removed of the basic chassis are also identical to each other. This makes it possible to use a common mold to produce the plurality of basic chassis with identical sidewalls removed, in advance, thereby further reducing the manufacturing costs of the keyboard device.

The above and other objects, features, and advantages of the invention will become more apparent from the following detailed description taken in conjunction with the accompanying drawings wherein like reference characters in the various figures are used to designate like components.

DETAILED DESCRIPTION OF PREFERRED EMBODIMENTS

The invention will now be described in detail with reference to the drawings showing preferred embodiments thereof.

Figure 1:
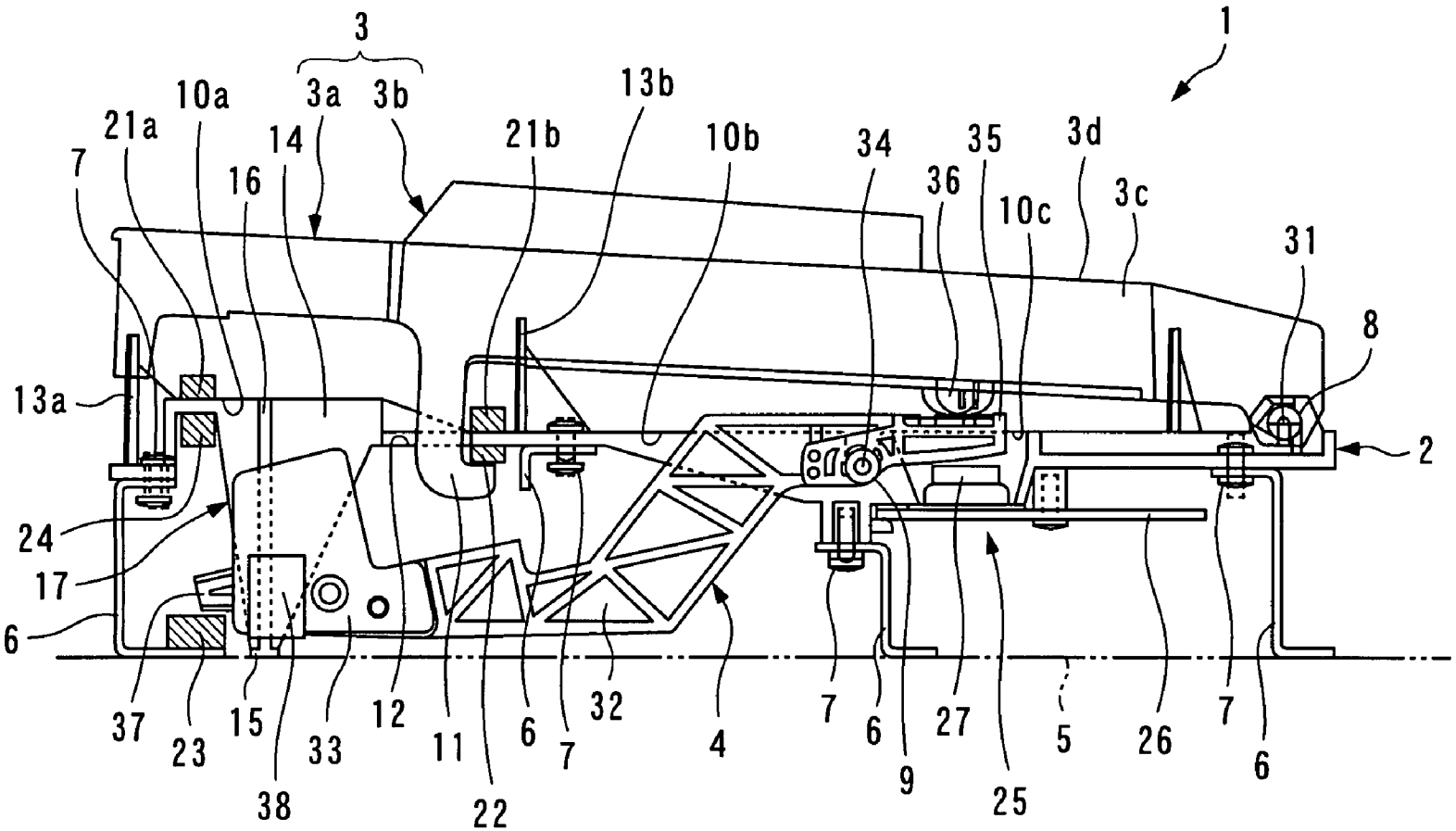
FIG. 1 is a side cross-sectional view showing a key-off state of a keyboard device for an electronic piano, according to a first embodiment of the present invention.
Figure 2:
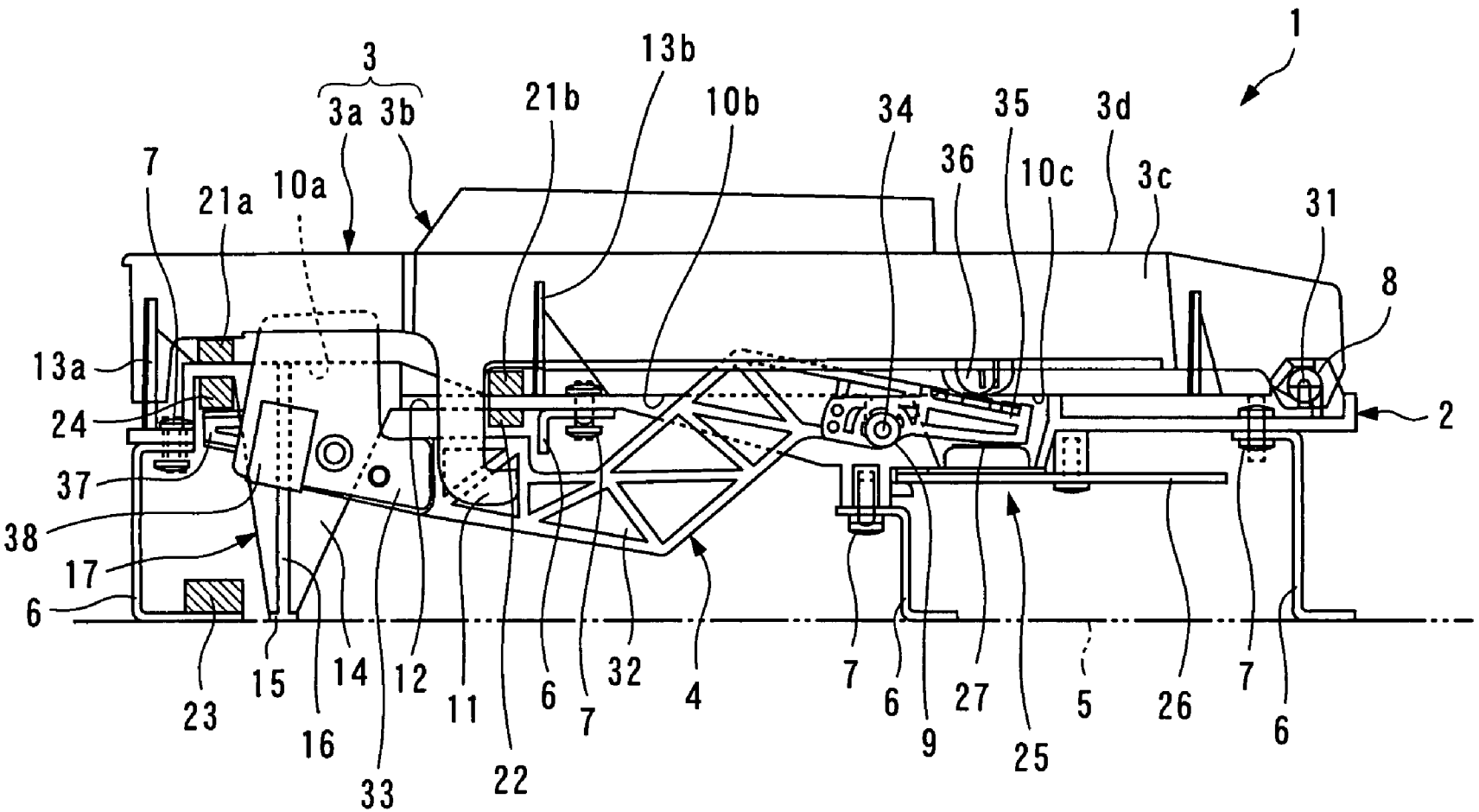
FIG. 2 is a side cross-sectional view showing a key-on state of the keyboard device in FIG. 1.

FIGS. 1 and 2 show a keyboard device for an electronic piano, according to a first embodiment of the present invention. The keyboard device 1 is for use in an 88-key piano, and includes a chassis assembly 2, 88 keys 3 comprised of white keys 3*a* (only one which is shown) and black keys 3*b* (only one which is shown) pivotally mounted on the rear end of the chassis assembly 2, and hammers 4 pivotally mounted to the central portion of the chassis assembly 2.

Figure 3B:
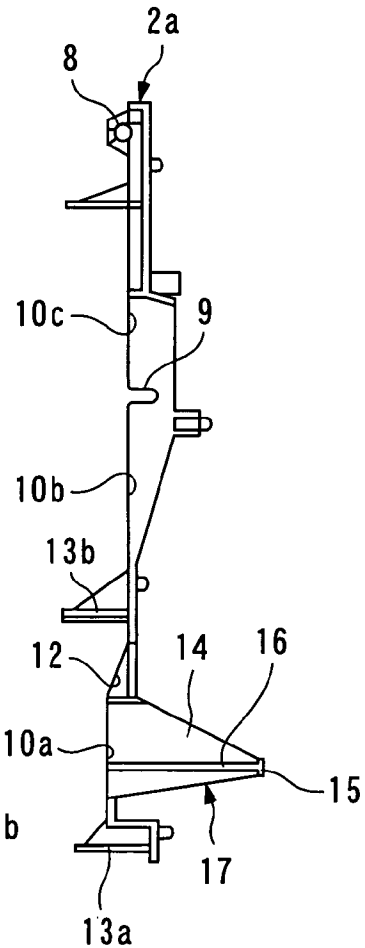
FIG. 3B is a side cross-sectional view of the basic chassis.
Figure 4:
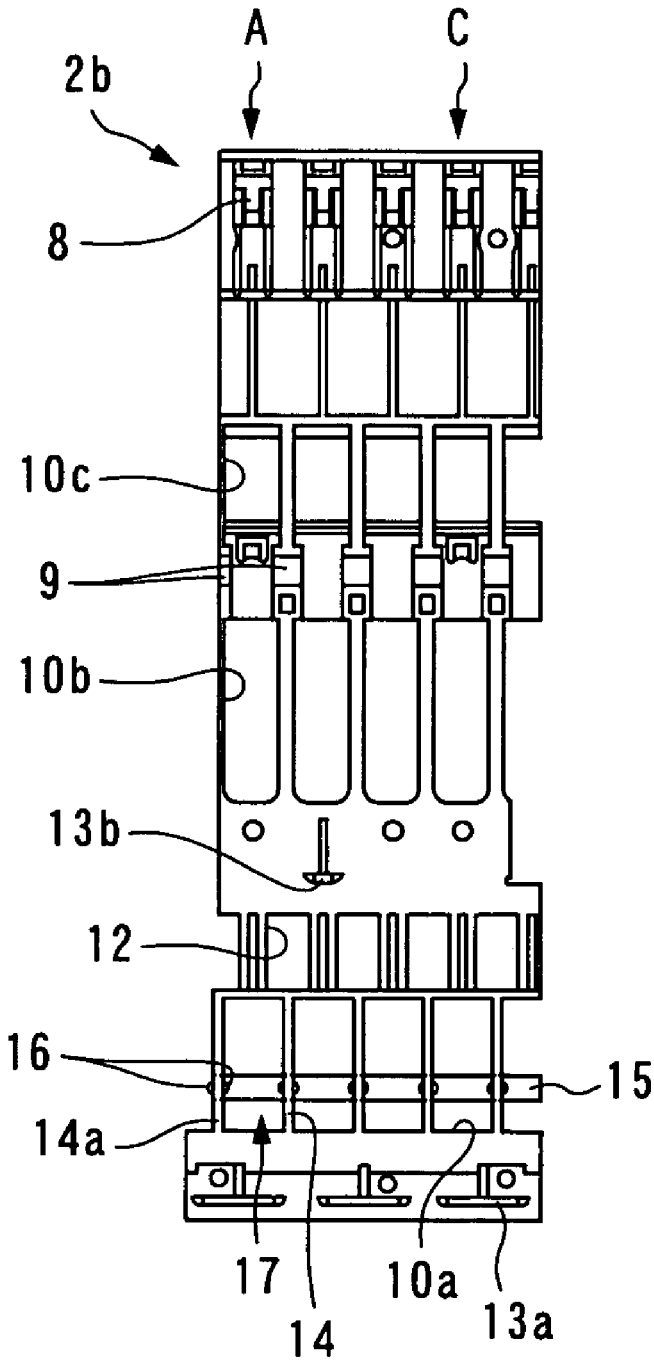
FIG. 4 is a plan view of a chassis for the highest pitch range.
Figure 5:
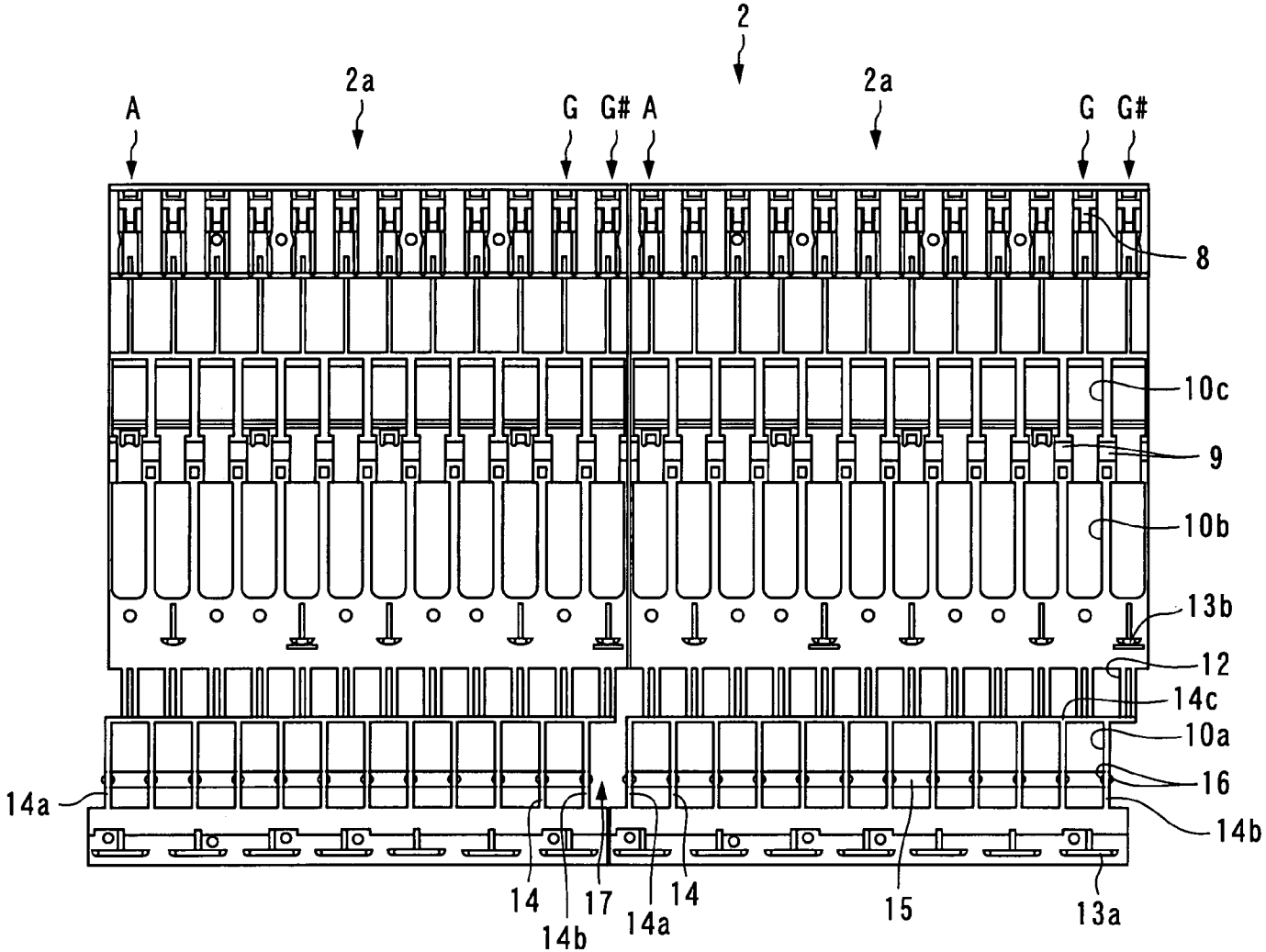
FIG. 5 is a plan view of basic chassis arranged in the left-right direction.

The chassis assembly 2 is constituted by a total of eight chassis: seven basic chassis 2*a* (one of which is shown in FIG. 3, and two of which are shown in FIG. 5), and a chassis 2*b* (see FIG. 4) for the highest pitch range, and the eight chassis are supported on a keybed 5 in a state arranged side by side in the left-right direction.

Figure 3A:
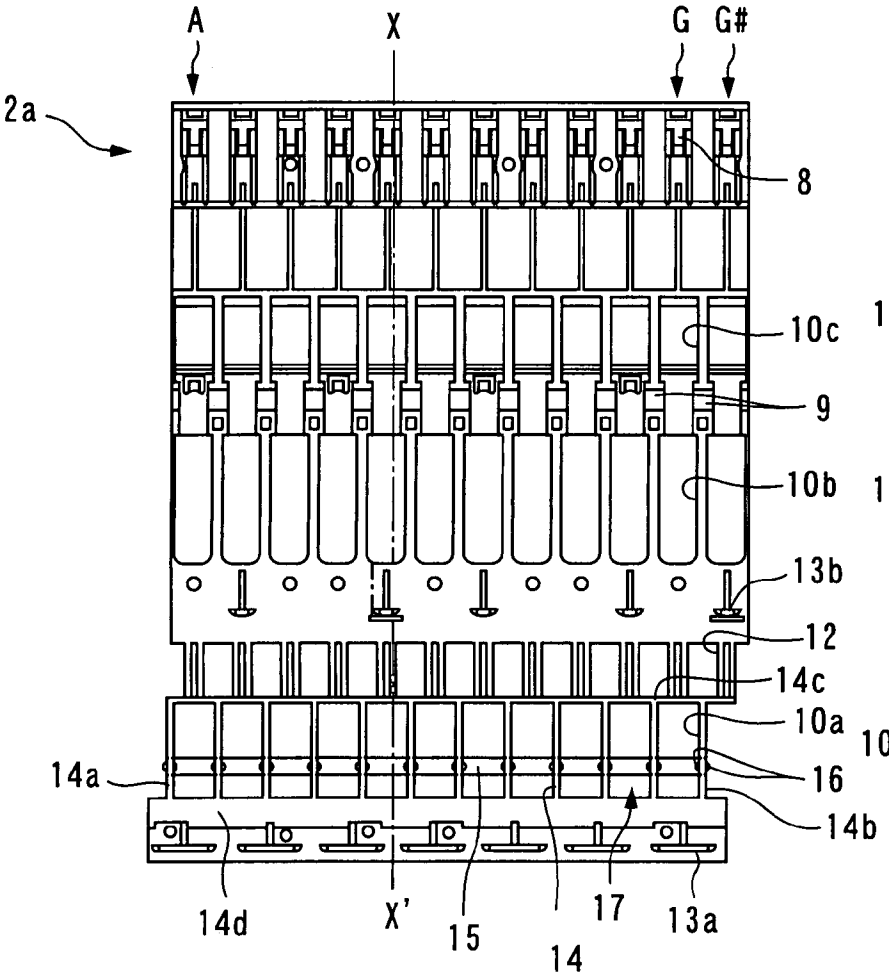
FIG. 3A is a plan view of a basic chassis of the keyboard device.

As shown in FIG. 3A, each basic chassis 2*a* is formed with rows of supports and holes, referred to hereinafter, for supporting the keys 3 and the hammers 4. The rows of supports and holes are provided for the respective keys 3 and arranged side by side in the left-right direction. More specifically, there are formed twelve rows (key-specific rows): a row for an A key to a row for a G# key (hereinafter referred to as "the A-key row", "the G#-key row", and so on), i.e. rows for one octave, which are arranged in the mentioned order from the left. Further, as shown in FIG. 5, the basic chassis 2*a* have the same size and shape, and are formed by injection molded articles of a synthetic resin (ABS resin, for example) which are molded using the same mold. As shown in FIG. 4, the chassis 2*b* for the highest pitch range is formed by part of one basic chassis 2*a*. More specifically, the chassis 2*b* for the lowest pith range is formed by a left part of the basic chassis 2*a* cut off along line X–X' in FIG. 3A, and supports a total of four keys 3, i.e. an A key to a C key.

The eight chassis are fixed by screws 7 to four connecting bars 6 extending in the left-right direction, whereby the chassis 2*a* to 2*c* are assembled in a state arranged side by side on the connecting bars 6 in the left-right direction. Each connecting bar 6 is a thin angular member having a length covering the entire length of the chassis assembly 2 in the left-right direction, which is formed e.g. by bending a steel plate.

As shown in FIGS. 3A and 3B, each of the aforementioned rows (key-specific rows) of the basic chassis 2*a* has key pivot holes 8 formed in a rear end thereof, for supporting the associated key 3, hammer pivot holes 9 formed in a central portion thereof, first to third hammer passage holes 10*a* to 10*c* formed respectively through a front part and portions frontward and rearward of the hammer pivot holes 9, for allowing the associated hammer 4 in pivotal motion to move therethrough, and a key passage hole 12 formed at a location rearward of the first hammer passage hole 10*a*, for allowing stopper portions 11 of the key 3 in pivotal motion to move therethrough. Further, on the basic chassis 2*a*, there are erected white key guides 13*a* at respective locations frontward of the first hammer passage holes 10*a* in association with the respective white keys 3*a*, and black key guides 13*b* at respective locations rearward of the key passage holes 12 in association with the respective black keys 3*b*.

Each adjacent pair of the first hammer passage holes 10*a* and 10*a* are separated by a sidewall 14. The basic chassis 2*a* is formed with such sidewalls 14: one at the left side of an A-key row to one at the right side of a G-key row, such that they have the same thickness and are arranged side by side at identical spaced intervals. As a result, the first hammer passage holes 10*a* for the A-key row to the G-key row are formed through the basic chassis 2*a* in a state arranged side by side at predetermined spaced intervals, and the right side (higher pitch side) of the first hammer passage hole 10*a* of a G#-key row is left open. As shown in FIG. 3B, each sidewall 14 extends vertically, and has an inverted-triangle shape in side view. Further, the basic chassis 2*a* is provided with a guide-connecting bar 15 placed on the keybed 5, for connecting the lower ends of the sidewalls 14, i.e. the sidewall at the left side of the A-key row (hereinafter referred to as "left end sidewall 14*a*") to the sidewall at the right side of the G-key row (hereinafter referred to as "right end sidewall 14*b*"), to each other. Further, the left and right side surfaces of each sidewall 14 are each formed with a guide protrusion 16 semi-circular in cross-section, which continuously extends from the guide-connecting bar 15 to the upper end of the sidewall 14. The sidewalls 14 and 14 at the opposite sides of each first hammer passage hole 10*a* and the guide protrusions 16 and 16 at the respective inner sides of these sidewalls 14 and 14 form a guide 17 for restricting the lateral motion of the hammer 4. The guide-connecting bar 15 and the guide protrusions 16 are integrally formed with the basic chassis 2*a*, and arranged slightly forward of the center of the first hammer passage hole 10*a*.

Figure 6:
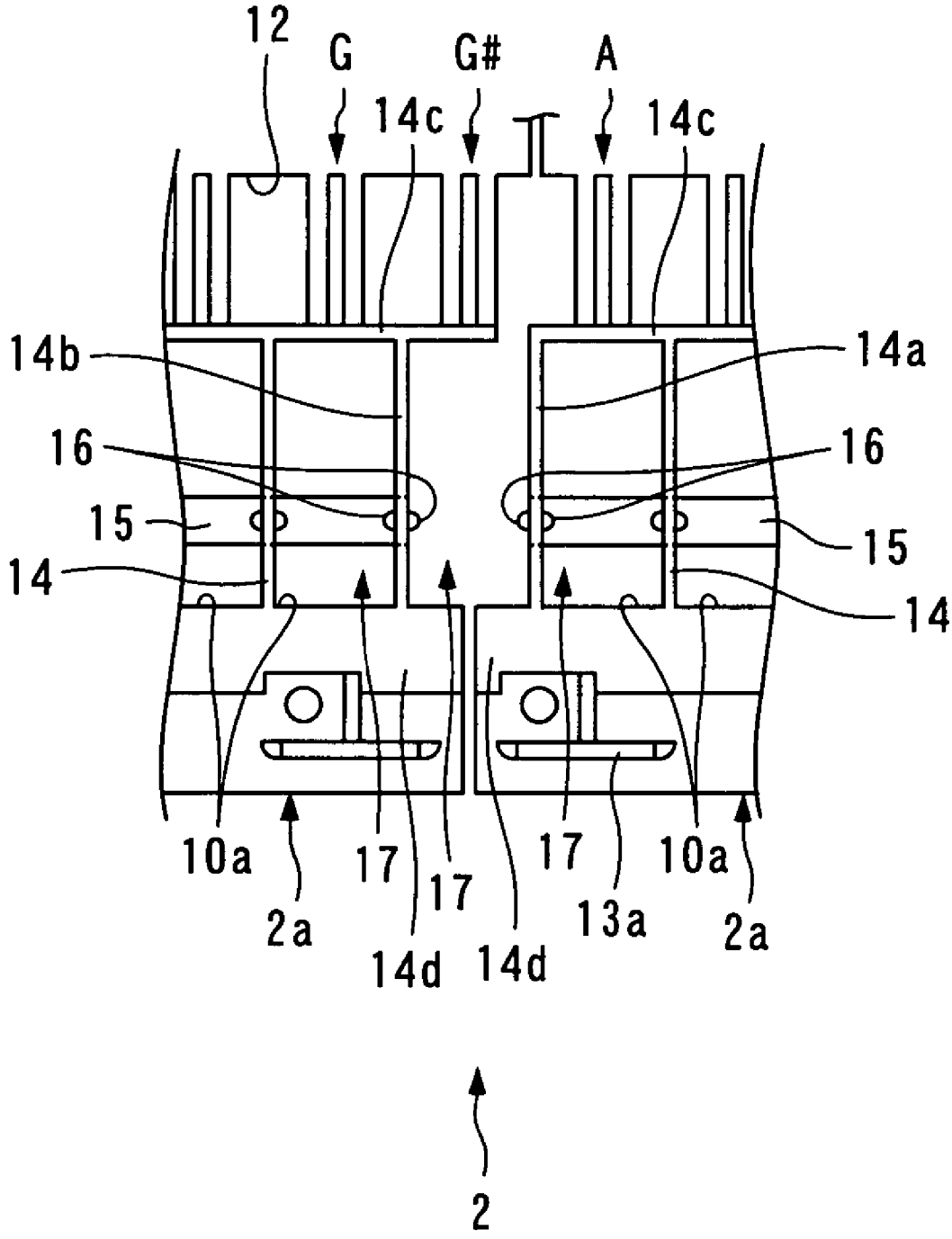
FIG. 6 is a fragmentary enlarged plan view showing guides at boundary portions of chassis.

Further, as shown in FIG. 6, the right end sidewall 14*b* is disposed inward of the right end of the basic chassis 2*a*, and a rear wall 14*c* associated therewith of the first hammer passage hole 10*a* extends rightward, i.e. toward the G#-key row, by a length of approximately two thirds of the width of the first hammer passage hole 10*a*, and a front wall 14*d* associated therewith of the first hammer passage hole 10*a* extends rightward by a length of approximately half the width of the first hammer passage hole 10*a*. On the other hand, the left end sidewall 14*a* is disposed flush with the left end of the basic chassis 2*a*, and the left end of a rear wall 14*c* associated therewith is flush with the left end sidewall 14*a*, and a front 14*d* associated therewith extends leftward by a length of approximately half the width of the first hammer passage hole 10*a*.

With the above arrangement, as shown in FIGS. 5 and 6, when basic chassis 2*a* and 2*a* are connected to each other, the right end sidewall 14*b* of the basic chassis 2*a* on the left side and the left end sidewall 14*a* of the basic chassis 2*a* on the right side are opposed to each other at the same distance as that between the sidewalls 14 and 14 of each of the first hammer passage holes 10*a* other than that of the G#-key row, and the left end sidewall 14*a* and the right end sidewall 14*b* define the first hammer passage hole 10*a* for the G#-key row at the boundary of the basic chassis 2*a*. Similarly, between a basic chassis 2*a* and the chassis 2*b* for the highest pitch range, a first hammer passage hole 10*a* for a G#-key row is defined, and a guide 17 for guiding the hammer 4 associated with a G# key is formed by the left end sidewall 14*a* and the right end sidewall 14*b* of theses chassis and the protrusions 16 and 16 on the inner side surfaces of these sidewalls.

Further, as shown in FIG. 1, the chassis assembly 2 is provided with a white-key lower limit stopper 21*a*, a black-key lower limit stopper 21*b*, a key upper limit stopper 22, a hammer lower limit stopper 23, and a hammer upper limit stopper 24, for restricting pivotal motions of the keys 3 and the hammers 4. The black-key lower limit stopper 21*b* and the key upper limit stopper 22 are attached to the upper and lower surfaces of the chassis assembly 2, respectively, at the same location between a lateral row of the key passage holes 12 and a lateral row of the associated black key guides 13*b*, such that they sandwich the chassis assembly 2. The hammer lower limit stopper 23 is attached to the lower end portion of the front connecting bar 6. Further, the white-key lower limit stopper 21a and the hammer upper limit stopper 24 are attached to the upper and lower surfaces of the chassis assembly 2, respectively, at a location rearward of a lateral row of the white key guides 13*a* such that they sandwich the chassis assembly 2. Each of the stoppers 21 to 24 is formed of a belt-like cushioning member extending over the entire length of the chassis assembly 2 in the left-right direction.

Further, at a location rearward of each pair of hammer pivot holes 9, a key switch 25 is provided on the chassis assembly 2, for detecting key-on information of the associated key 3. The key switch 25 is comprised of a printed circuit board 26 fixed to the chassis assembly 2 by screws and a switch body 27 disposed on the top of the printed circuit board 26. The switch body 27 faces the associated third hammer passage hole 10*c* from below, and is connected to a control unit (not shown) for controlling tone generation of the electronic piano, via the printed circuit board 26.

Each of the keys 3 (the white keys 3*a* and the black keys 3*b*) is formed e.g. by an injection molded article of an AS resin, and is comprised of two sidewalls 3*c* (only one of which is shown) and a top wall 3*d*, with an inverted U-shaped cross-section. Each of the sidewalls 3*c* of the key 3 has a rear end thereof formed with a protrusion 31 protruding inward, and the protrusion 31 is fitted into the associated key pivot hole 8 formed in the rear end of the chassis assembly 2, whereby the key 3 is pivotally supported by the chassis assembly 2. Further, the key 3 is formed with the stopper portions 11 which are hook-shaped and extend downward from the front portions of the two sidewalls 3*c*, respectively.

On the other hand, each hammer 4 is comprised of a hammer body 32 extending in the front-rear direction and two weight plates 33 (only one of which is shown) attached to the respective left and right side surfaces of the front end of the hammer body 32. The hammer body 32 has a rear end thereof formed with pin-shaped protrusions 34 laterally protruding from the respective opposite side surfaces. The protrusions 34 are engaged in the respective adjacent hammer pivot holes 9 formed at the boundary of each adjacent two of the aforementioned rows (key-specific rows) of the chassis assembly 2 such that they span the adjacent two hammer pivot holes 9, whereby the hammer 4 is pivotally supported by the chassis assembly 2. The weight plates 33, which are provided for adding touch weight similar to that of an acoustic piano to the hammer 4, are formed of a heavy material, such as a steel plate. Further, each weight plate 33 has a rectangular cushioning member 38 attached to a lower portion of a side surface thereof at a location corresponding to the guide protrusion 16. The cushioning member 38 serves to make the weight plate 33 slidable and prevent generation of noise when the weight plate 33 comes into contact with the guide protrusion 16.

A portion of the hammer body 32 rearward of the hammer pivot holes 9 forms a switch pressing portion 35. The switch pressing portion 35 is positioned in facing relation to the associated third hammer passage hole 10*c* of the chassis assembly 2, and opposed to the switch body 27 of the key switch 25 from above. An actuator portion 36 formed on the lower surface of the key 3 is in abutment from above with the switch pressing portion 35. Further, the central portion of the hammer 4 passes through the associated second hammer passage hole 10*b* of the chassis assembly 2 in a manner crossing the same from above and extends forward below the chassis assembly 2, and the front end of the hammer 4 is formed with a hammer stopper portion 37 protruding forward.

With the arrangement described above, as a key 3 is depressed, the switch pressing portion 35 of the hammer 4 is pressed by the actuator portion 36 of the key 3 to cause the hammer 4 to pivotally move clockwise, as viewed in FIG. 1, and the weight plates 33 attached to the front end of the hammer 4 move through the first hammer passage hole 10*a* from below. During this operation, the lateral motion of the hammer 4 is restricted by the sidewalls 14 and the guide protrusions 16 of the guide 17.

In accordance with the pivotal motion of the hammer 4, the switch pressing portion 35 depresses the switch body 27 of the key switch 25 to turn on the same. As a result, key-on information of the key 3 is detected, and the tone generation of the electronic piano is controlled based on the result of the detection.

As described above, with the arrangement of the keyboard device 1 for an electronic piano, according to the present embodiment, it is possible to restrict the lateral motion of the hammer 4 by the guide 17 provided in the front end of the chassis assembly 2. Therefore, when the electronic piano is placed vertically e.g. for storage, the guide 17 can prevent the hammer 4 from hanging down due to its own weight. Thus, the hammer 4 is supported by the guide 17 without hardly hanging down, and hence bending moment acting on the hammer 4 due to its own weight is reduced, which makes it possible to prevent deformation of the hammer 4. As a consequence, musical performance on the electronic piano can be carried out without inconvenience when the electronic piano is in normal position. Further, even if the hammer 4 laterally moves out of its proper path of motion during musical performance, the hammer 4 comes into contact with only the guide protrusion 16 semicircular in cross section and extending vertically, so that an area with which the hammer 4 comes into contact is smaller and hence friction due to contact is also smaller than when the hammer 4 comes into contact with the sidewall 14, which is larger in area. This makes it possible to prevent degradation of the touch feeling of the key 3 and generation of noise.

Further, since the guide 17 of the hammer 4 for the G# key at the boundary between a basic chassis 2*a* and an adjacent basic chassis 2*a* or the chassis 2*b* for the highest pitch range is formed by the left end sidewall 14*a* of one of the chassis and the right end sidewall 14*b* of the other of the same, it is possible to secure the same thickness for each of the sidewalls 14*a* and 14*b* as that of the sidewalls at the other locations than the boundary. This makes it possible to ensure sufficient strength of the guide 17 at the boundary similarly to the other guides 17. Further, the increased thickness of the sidewall 14*s* at the boundary makes the sidewalls 14 difficult to deform and vibrate, which makes it possible to prevent noise from being generated when the hammer 4 is brought into contact with the sidewall 14. As a consequence, it becomes unnecessary to perform the process of bonding the boundary portions of the chassis 2 for prevention of generation of noise, which reduces the number of manufacturing steps, and makes it easy to decompose the chassis 2.

Further, since the basic chassis 2*a* are each formed by an identical unit for one octave, it is possible to reduce the cost of molds by using the common mold therefor. Further, for an 88-key electronic piano of a normal type, the chassis assembly 2 can be formed by seven basic chassis 2*a* and one chassis 2*b* for the highest pitch range, which dispenses with the conventional chassis for the lowest pitch range. Further, since the sidewalls 14 and the guide protrusions 16 forming each guide 7 are integrally formed with the chassis assembly 2, the operation of mounting the guides 7 to the chassis 2 can be dispensed with. From the above, it is possible to reduce the manufacturing costs of the electronic piano. Further, since the basic chassis 2*a* is formed by a molded article of a synthetic resin, such as an ABS resin, it is possible to manufacture the basic chassis 2*a* having a desired shape and a strength characteristic without undesired variation.

Next, a keyboard device for a keyboard instrument, according to a second embodiment of the present invention will be described in detail with reference to FIGS. 7 to 14.

Figure 7:
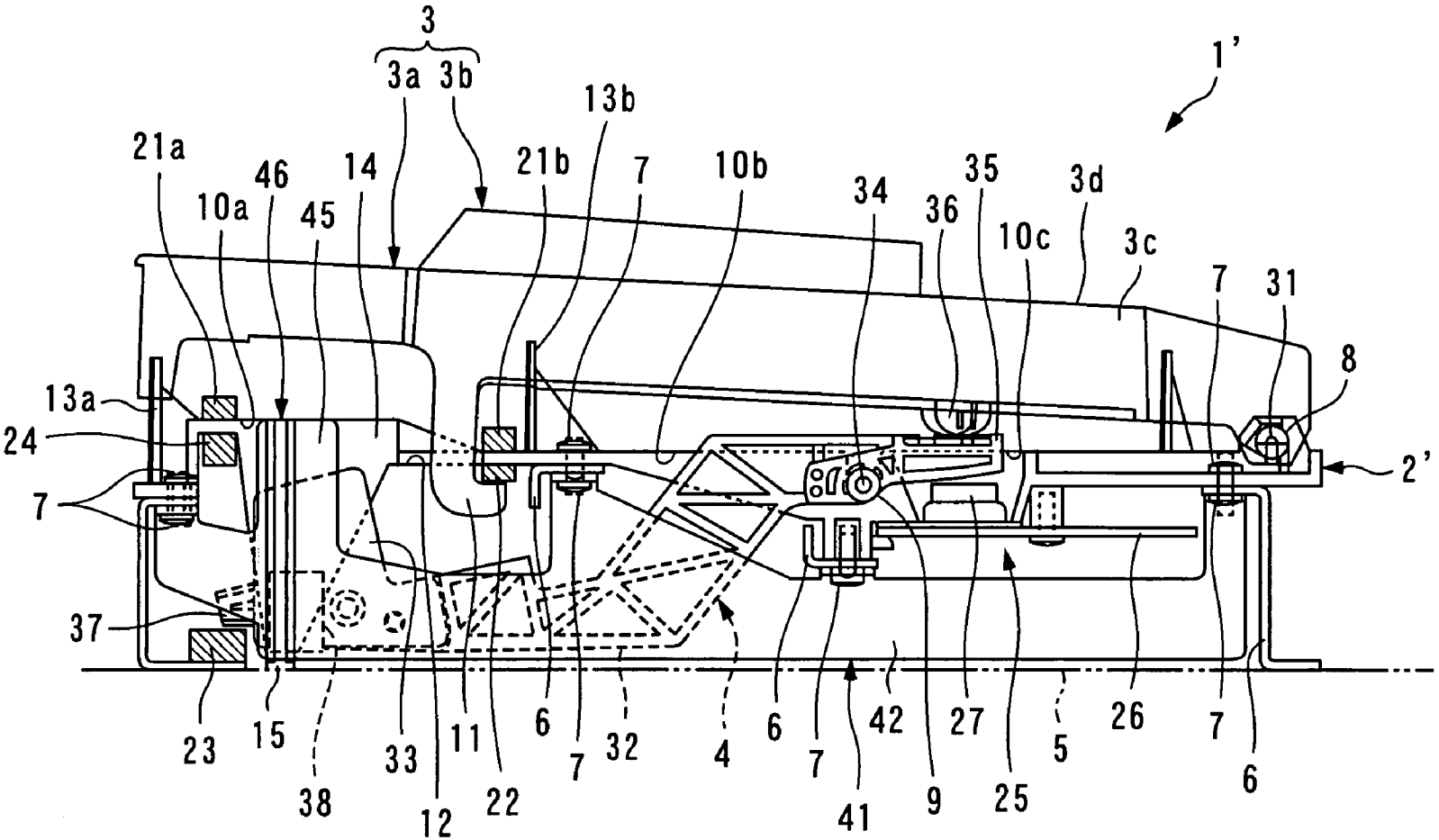
FIG. 7 is a side cross-sectional view showing a key-off state of a keyboard device for an electronic piano, according to a second embodiment of the present invention.
Figure 8:
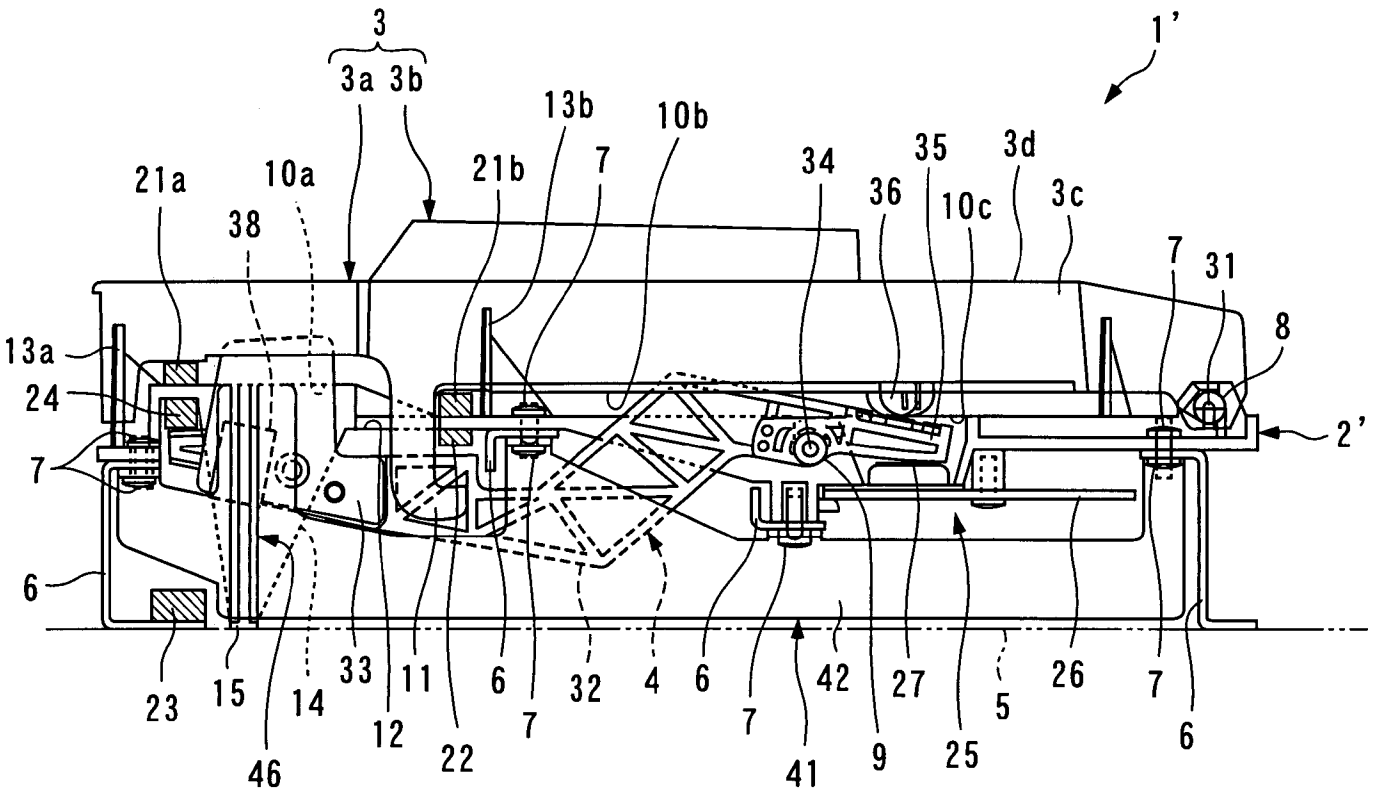
FIG. 8 is a side cross-sectional view showing a key-on state of the keyboard device in FIG. 7.

FIGS. 7 and 8 show a keyboard device for an electronic piano, according to the second embodiment of the present invention. The keyboard device 1' is for use in an 88-key piano, and includes a chassis assembly 2', 88 keys 3 comprised of white keys 3*a* (only one which is shown) and black keys 3*b* (only one which is shown) pivotally mounted on the rear end of the chassis assembly 2', and hammers 4 pivotally mounted to the central portion of the chassis assembly 2'.

Figure 9B:
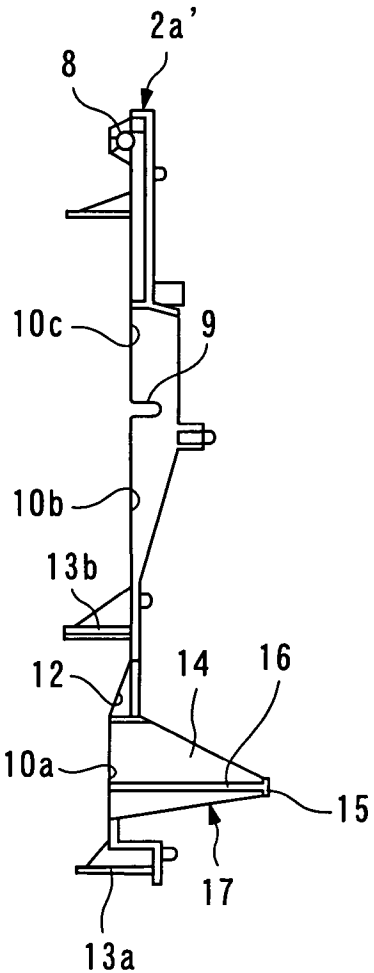
FIG. 9B is a side cross-sectional view of the basic chassis.
Figure 9A:
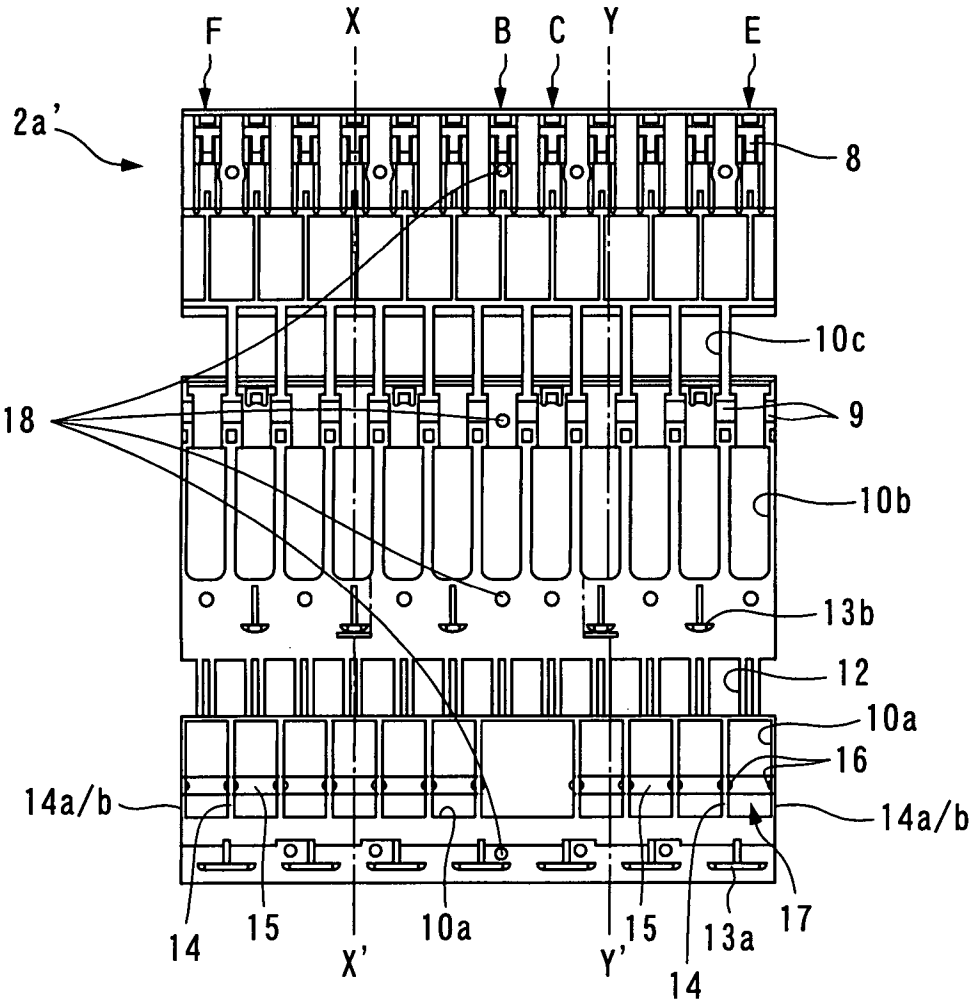
FIG. 9A is a plan view of a basic chassis of the keyboard device.
Figure 13:
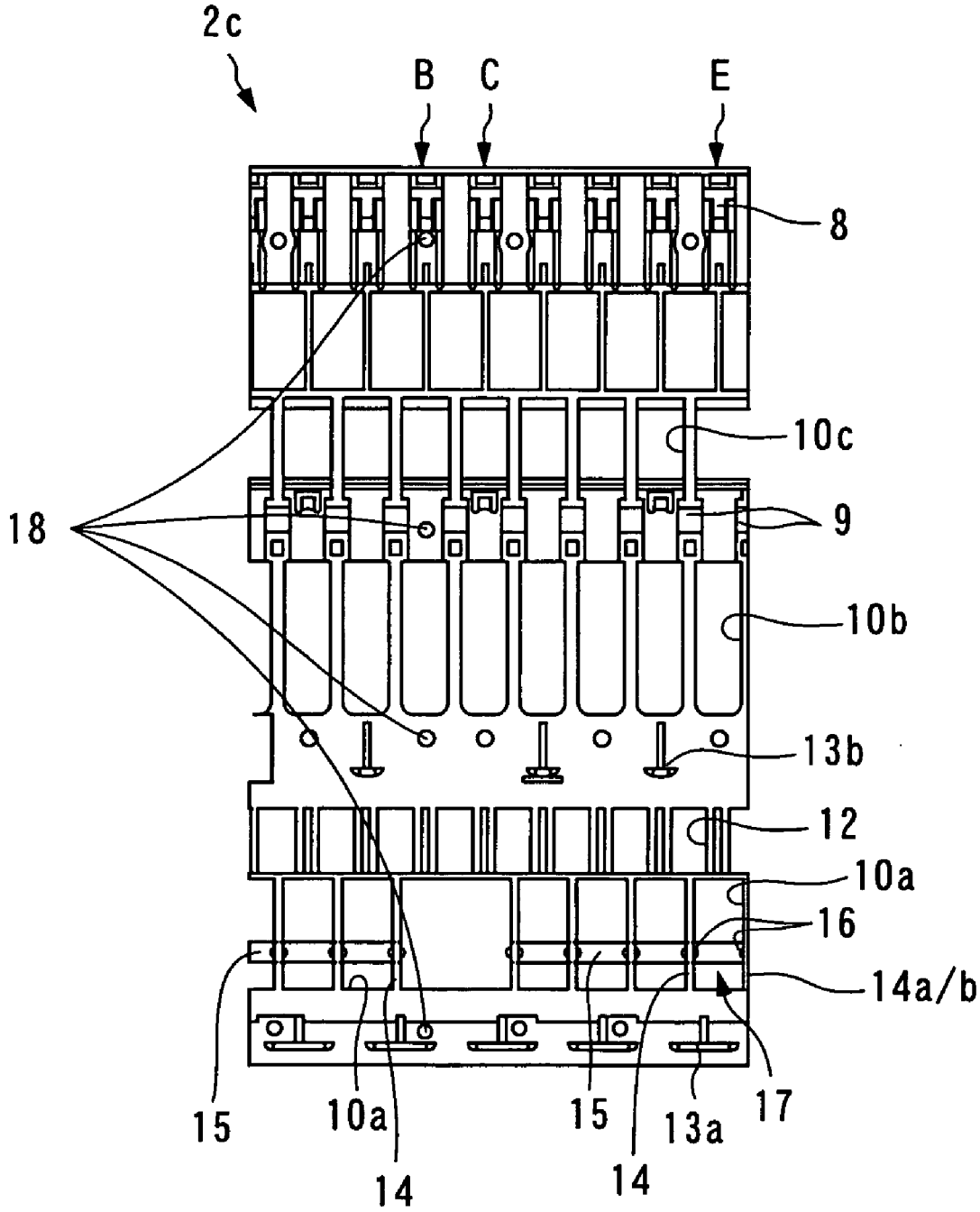
FIG. 13 is a plan view of a chassis for the lowest pitch range.
Figure 14:
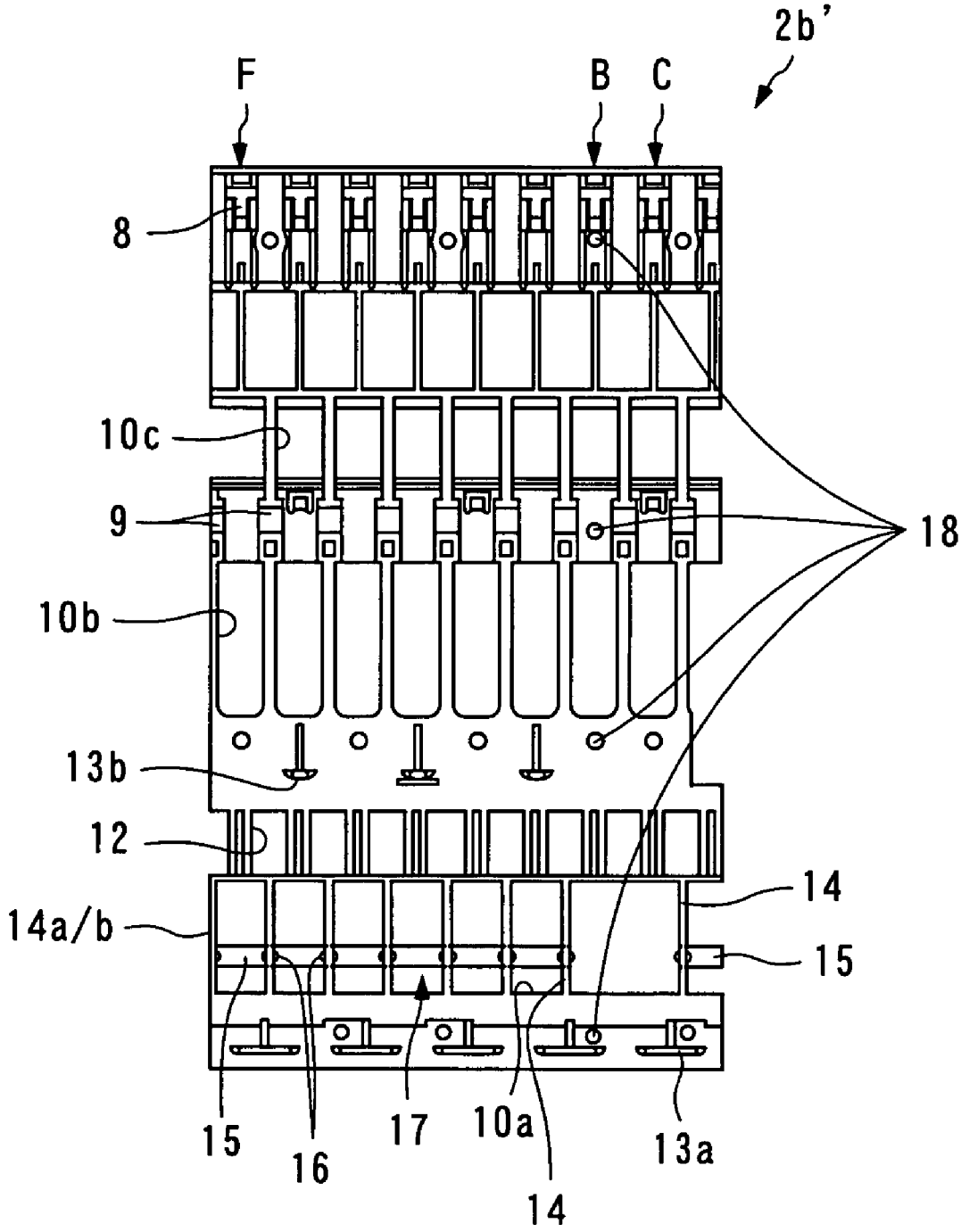
FIG. 14 is a plan view of a chassis for the highest pitch range.
Figure 15:
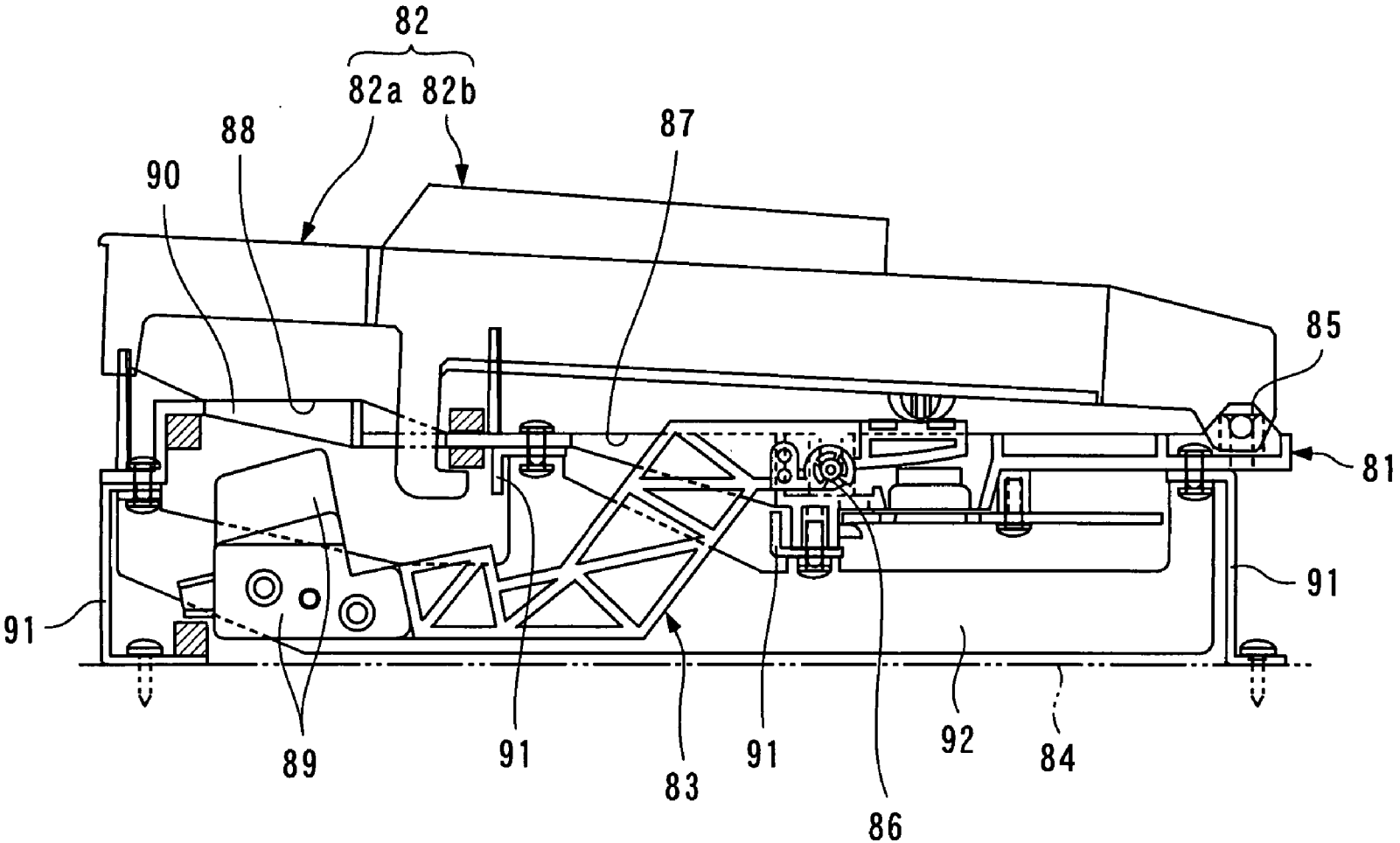
FIG. 15 PRIOR ART
FIG. 15 is a side cross-sectional view of a conventional keyboard device for an electronic piano.
Figure 16:
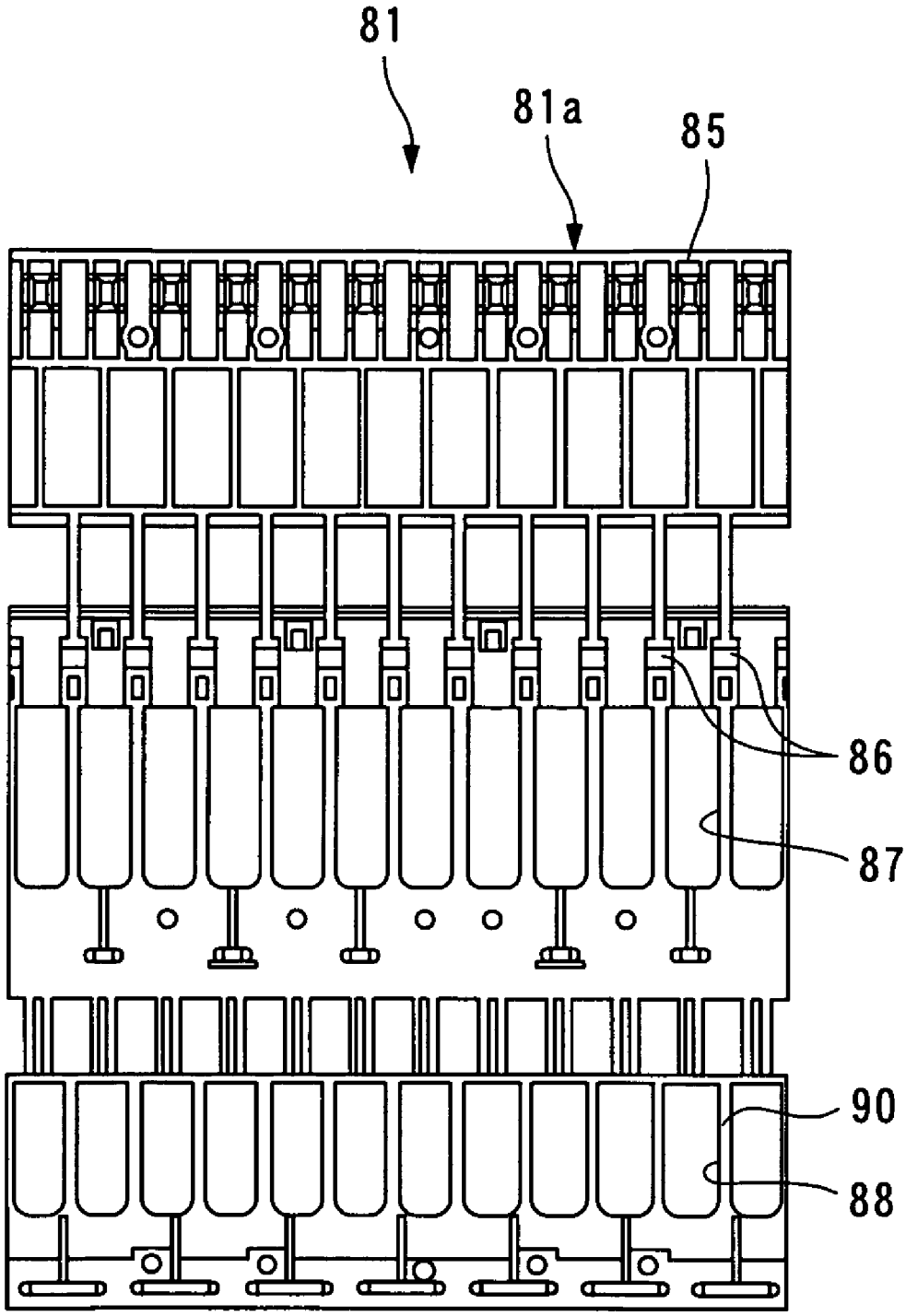
FIG. 16 PRIOR ART
FIG. 16 is a plan view of a conventional chassis.
Figure 17:
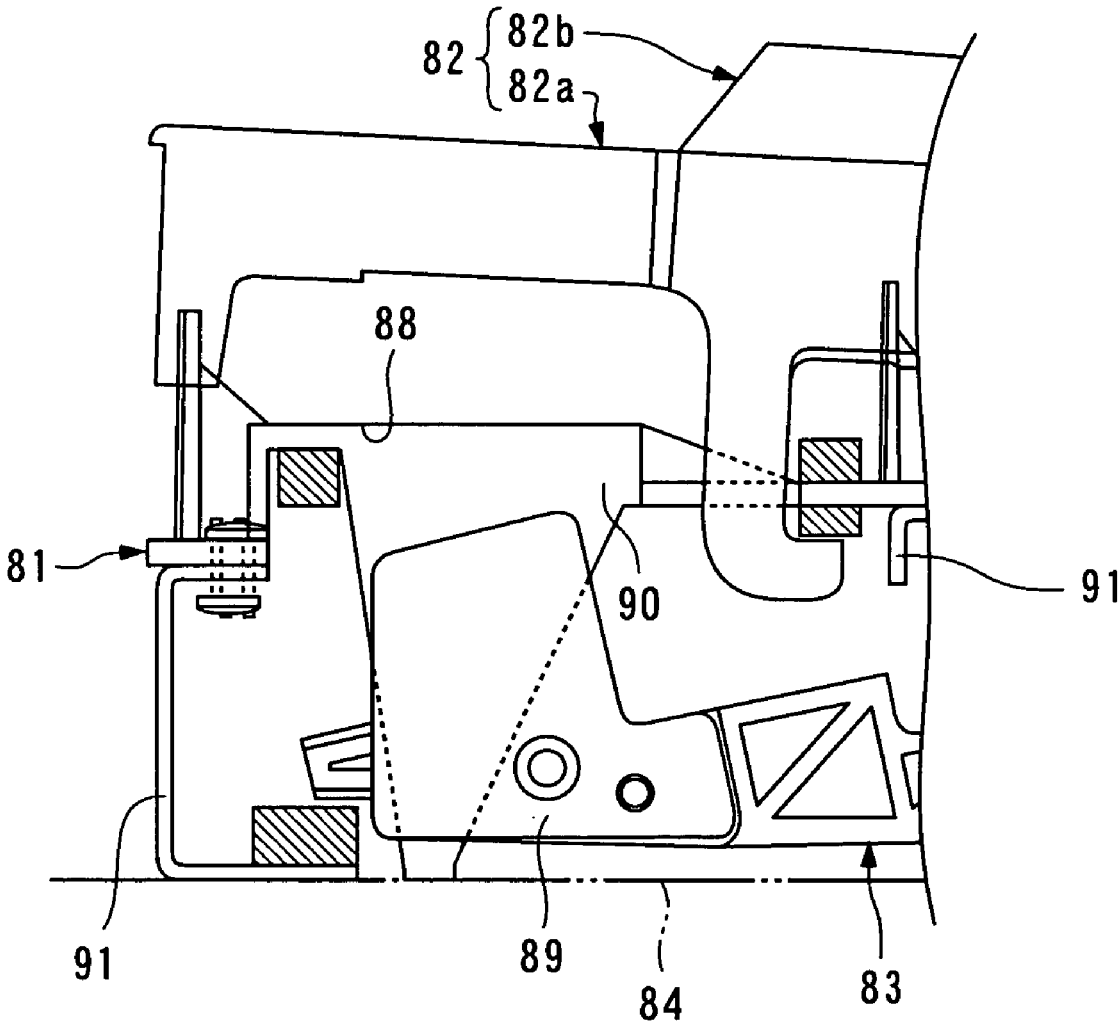
FIG. 17 PRIOR ART
FIG. 17 is a fragmentary enlarged cross-sectional view showing a variation of the chassis of the FIG. 15 keyboard device in which sidewalls are extended vertically.
Figure 18:
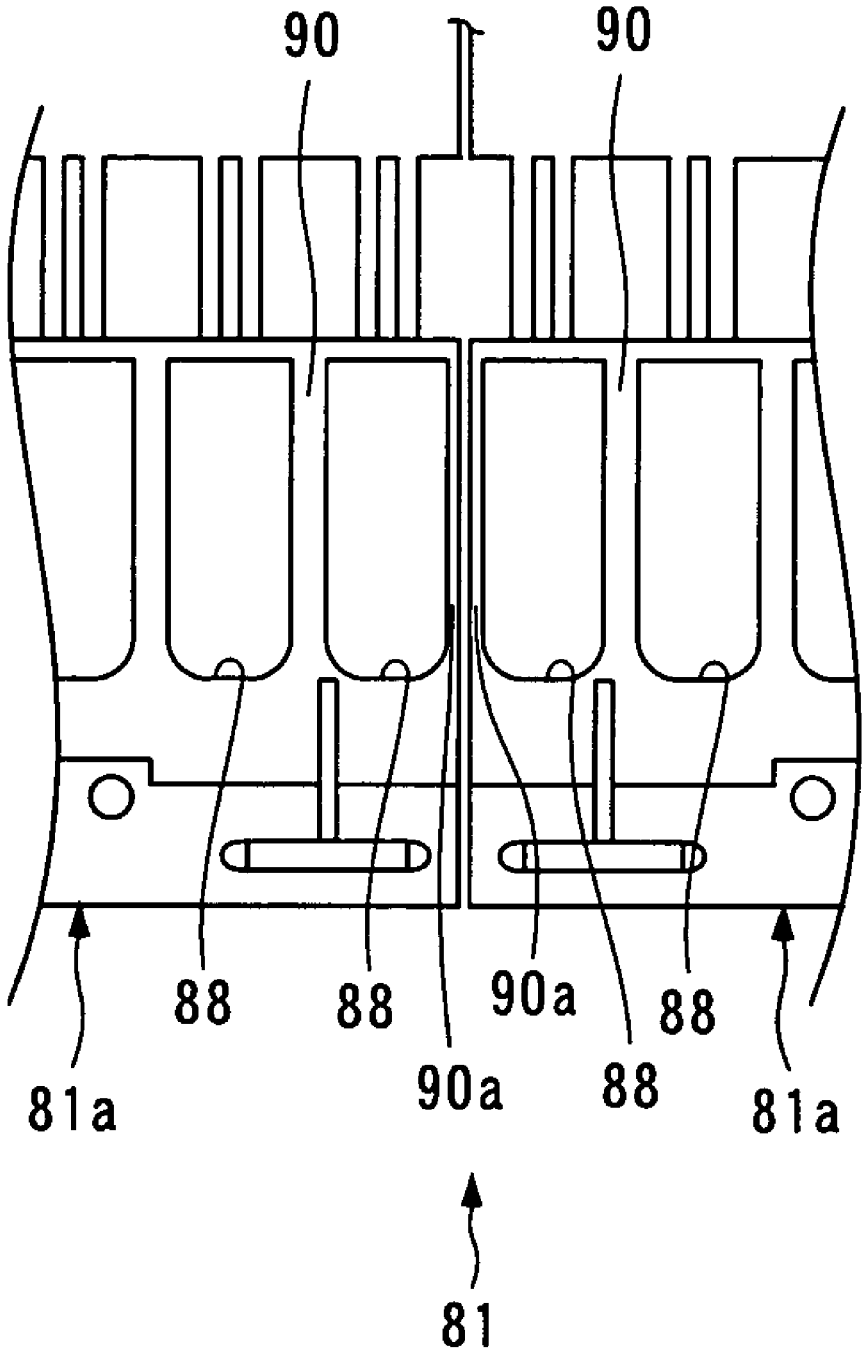
FIG. 18 PRIOR ART
FIG. 18 is a fragmentary enlarged plan view of the chassis in FIG. 17 in a state arranged side by side in the left-right direction.

The chassis assembly 2' is constituted by a total of eight chassis: six basic chassis 2*a*' (only one of which is shown in FIG. 9A), a chassis 2*c*, shown in FIG. 13, for the lowest pitch range, and a chassis 2*b*', shown in FIG. 14, for the highest pitch range, and the eight chassis are supported on a keybed 5 in a state arranged side by side in the left-right direction.

As shown in FIG. 9A, each basic chassis 2*a*' is formed with rows of supports and holes, referred to hereinafter, for supporting the keys 3 and the hammers 4. The rows of supports and holes are provided for the respective keys 3 and arranged side by side in the left-right direction. More specifically, there are formed twelve rows: a row for an F key to a row for an E key (hereinafter referred to as "the F-key row", "the E-key row", and so on), i.e. rows for one octave, which are arranged in the mentioned order from the left, with the associated key 3 and hammer 4 mounted therein. Further, the basic chassis 2*a*' have the same size and shape, and are formed by injection molded articles of a synthetic resin (ABS resin, for example), which are molded using the same mold.

As shown in FIGS. 13 and 14, the chassis 2*b*' for the highest pitch range and the chassis 2*c* for the lowest pitch range are each formed by part of the basic chassis 2*a*'. More specifically, the chassis 2*b*' for the highest pitch range is formed by a right part of the basic chassis 2*a*' cut off along line X–X' in FIG. 9A. On the other hand, the chassis 2*c* for the lowest pitch range is formed by a left part of the basic chassis 2*a*' cut off along line Y–Y' in FIG. 9A.

The eight chassis 2*a* to 2*c* are fixed by screws 7 inserted through the chassis assembly 2' from above to four connecting bars 6 extending below the chassis assembly 2' in the left-right direction, as shown in FIG. 7, whereby the chassis 2*a* to 2*c* are assembled in a state arranged side by side on the connecting bars 6 in the left-right direction. It should be noted that only the second connecting bar 6 as counted from the rear of the chassis assembly 2' (right-hand side as viewed in FIG. 7) is fixed to the chassis assembly 2' from below by the screws 7. Each connecting bar 6 is a thin angular member having a length covering the entire length of the chassis assembly 2' in the left-right direction, which has a plurality of holes (not shown) formed therethrough and is formed e.g. by bending a steel plate.

As shown in FIGS. 9A and 9B, each of the aforementioned rows (key-specific lows) of the basic chassis 2*a*' has key pivot holes 8 formed in a rear end thereof, for supporting the associated key 3, hammer pivot holes 9 formed in a central portion thereof, first to third hammer passage holes 10*a* to 10*c* formed respectively through a front part and portions frontward and rearward of the hammer pivot holes 9, for allowing the associated hammer 4 in pivotal motion to move therethrough, and a key passage hole 12 formed at a location rearward of the first hammer passage hole 10*a*, for allowing stopper portions 11 of the key 3 in pivotal motion to move therethrough. Further, on the basic chassis 2*a*', there are erected white key guides 13*a* at locations frontward of the respective first hammer passage holes 10*a* in association with the respective white keys 3*a*, and black key guides 13*b* at locations rearward of the respective key passage holes 12 in association with the respective black keys 3*b*.

In the front end of the basic chassis 2*a*', there are formed twelve sidewalls 14 such that they are arranged side by side in the left-right direction at equally-spaced intervals, and each of the first hammer passage holes 10*a* is defined between each adjacent two of the sidewalls 14 and 14. A portion of the basic chassis 2*a*' between the B-key row and C-key row is formed with no sidewalls 14, and in this portion, there is mounted a rib 41, referred to hereinafter, in place of the sidewall 14. Between the rib 41 and the respective sidewalls 14 leftward and rightward of the rib 41, there are formed first hammer passage holes 10*a*.

Further, leftmost and rightmost sidewalls (hereinafter referred to as "the end sidewalls 14*a/b*") of the plurality of the sidewalls 14 are formed such that they have approximately half the thickness of the other sidewalls 14. One of the end sidewalls 14*a/b* and an end sidewall 14*a/b* of an adjacent chassis connected to the basic chassis 2*a*' form one sidewall 14. As a consequence, the first hammer passage holes 10*a* are formed such that they are arranged side by side in the left-right direction at predetermined spaced intervals over the entire length of the chassis assembly 2'.

As shown in FIG. 9B, the sidewalls 14 are integrally formed with the basic chassis 2*a*' and each extend vertically with an inverted triangular shape in side view. Further, the basic chassis 2*a*' is formed with two guide-connecting bars 15: one for connecting the respective lower ends of sidewalls 14, i.e. a left end sidewall 14*a/b* to the left-side sidewall 14 of a B-key row, and the other for connecting the respective lower ends of sidewalls 14, i.e. the right-side sidewall 14 of a C-key row to a right end sidewall 14*a/b*. The two guide-connecting bars 15 extend on the same straight line, and are placed on the keybed 5. Further, on the left and right side surfaces of each sidewall 14 and the inner side surface of each end sidewall 14*a/b*, there extend respective guide protrusions 16, semicircular in cross section, continuously from the guide-connecting bar 15 to the upper end of the sidewall 14. The guide-connecting bars 15 and the guide protrusions 16 are integrally formed with the basic chassis 2*a*', and each located slightly forward of the center of the first hammer passage hole 10*a*. Except for the B-key row and the C-key row, the sidewalls 14 and 14 on the opposite sides of the first hammer passage hole 10*a* and the respective guide protrusions 16 and 16 on the inner side surfaces of the sidewalls 14 and 14 form a guide 17 for restricting the lateral motion of the hammer 4.

Figure 10:
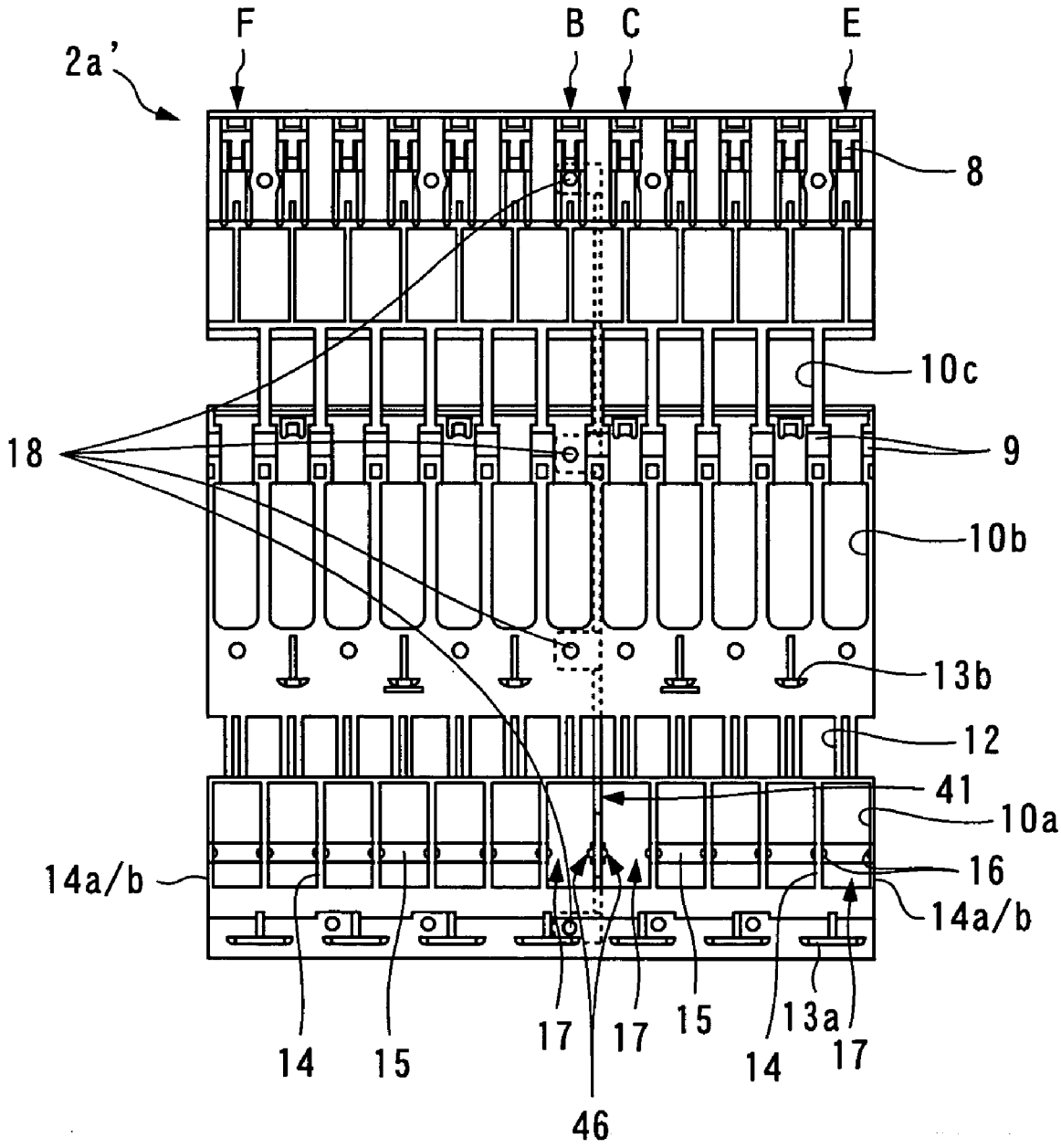
FIG. 10 is a plan view of the basic chassis having a rib mounted therein.
Figure 12A:
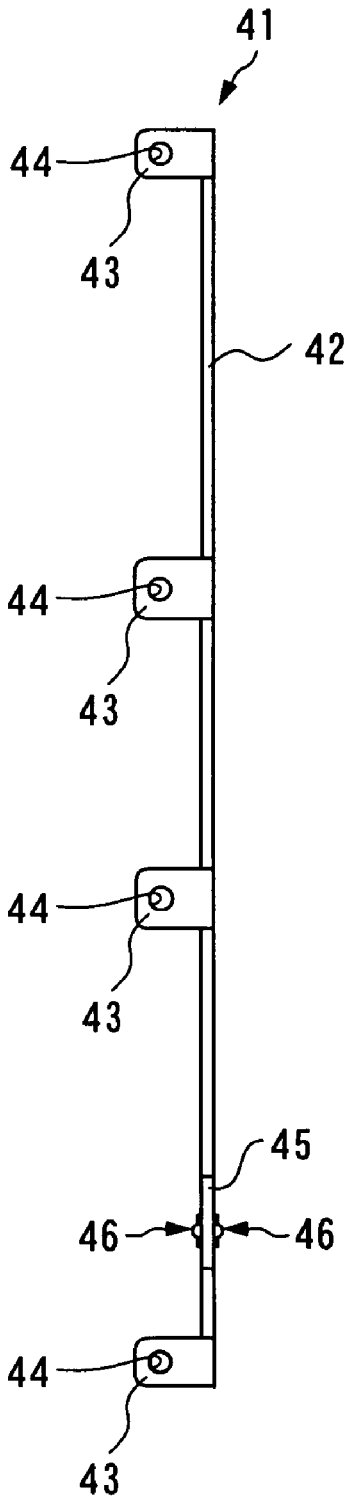
FIG. 12A is a plan view of the rib.
Figure 12B:
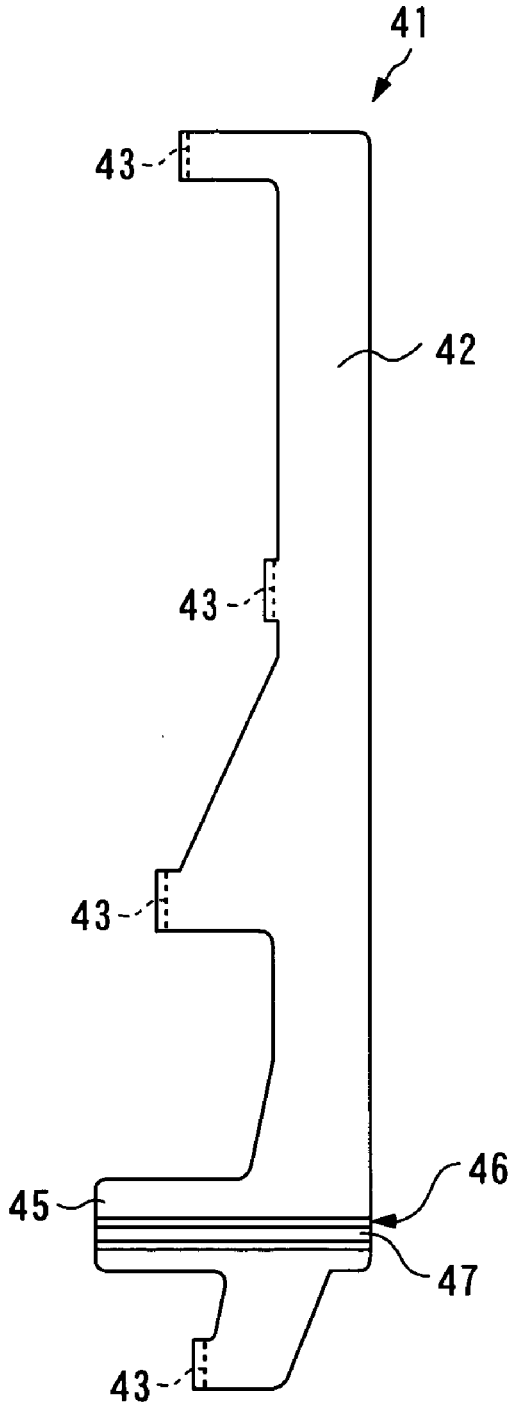
FIG. 12B is a side view of the rib.

Further, a portion of the basic chassis 2*a*' corresponding to the B-key row has four rib fixing holes 18 formed at respective locations corresponding to the four connecting bars 6 (see FIG. 13) such that they are aligned in the front-rear direction. As shown in FIG. 10, the basic chassis 2*a*' has a reinforcing rib 41 mounted thereon via the rib fixing holes 18, and the rib 41 extends in the front-rear direction between the B-key row and the C-key row. As shown in FIGS. 12A and 12B, the rib 41 is comprised of a rib body 42 extending in the front-rear direction, and guide protrusion members 46 mounted on the rib body 42. The rib body 42 is formed e.g. by press bending of a steel plate such that it has the same thickness as that of the sidewall 14. Further, the rib body 42 has the upper end thereof formed with four horizontal mounting portions 43 at respective predetermined locations spaced in the front-rear direction. Each mounting portion 43 is formed therethrough with a mounting hole 44. The screws 7 are screwed into the respective rib fixing holes 18 of the basic chassis 2*a*' from below via the mounting holes 44 of the rib 41 and the respective holes of the associated connecting bars 6, as shown in FIG. 7, whereby the rib 41 is mounted to the basic chassis 2*a'*.

Further, a portion of the rib body 42 close to the front end thereof protrudes upward to form a hammer guide portion 45. The hammer guide portion 45, which plays the role of the sidewall 14 between the B-key row and the C-key row, has the same height as the sidewall 14 as shown in FIG. 7, and has left and right side surfaces thereof formed with a plurality of mounting holes (not shown).

Figure 11:
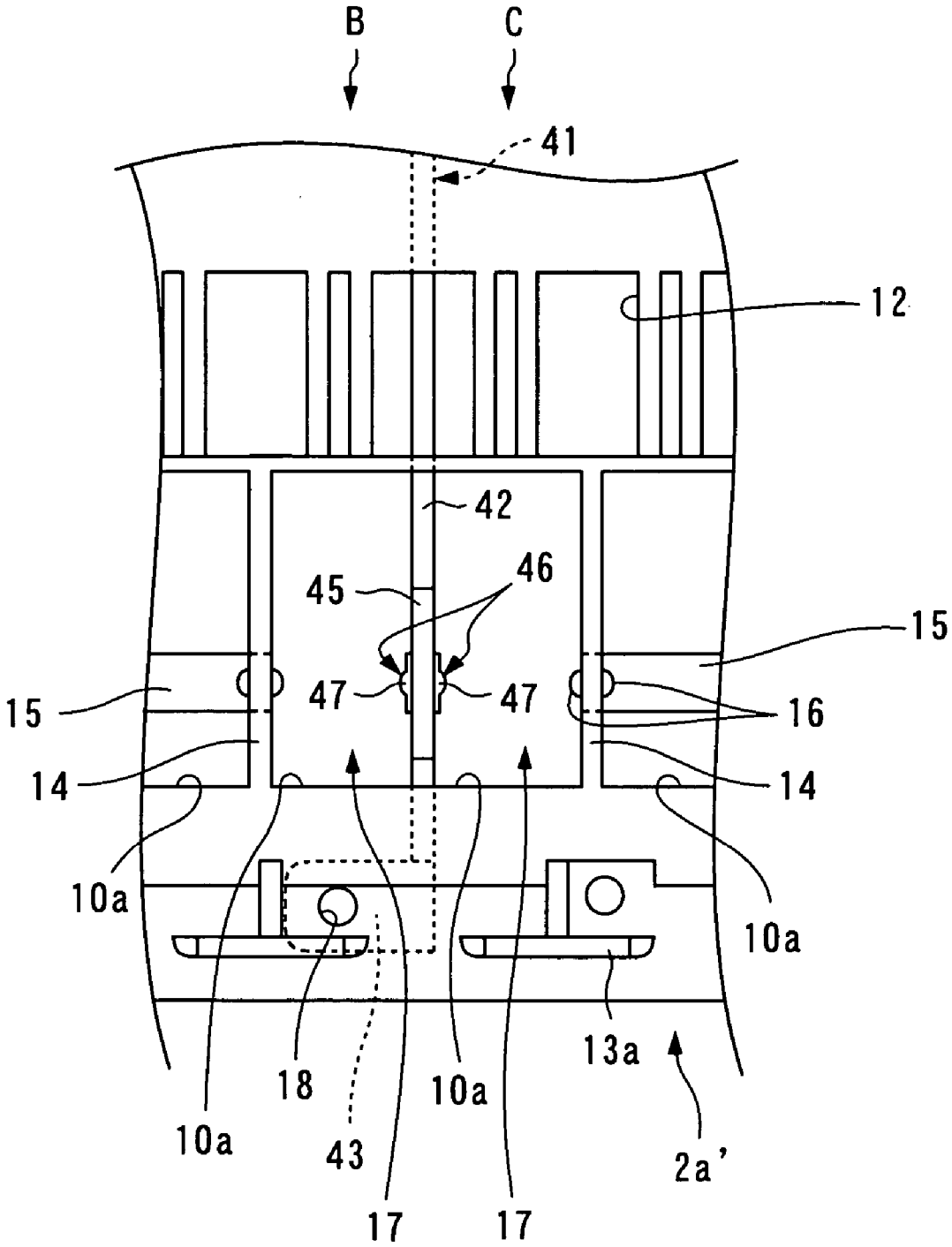
FIG. 11 is a fragmentary enlarged plan view of FIG. 10.

As shown in FIGS. 11 and 12A and 12B, each guide protrusion member 46 is a rectangular plate extending vertically, and has a guide protrusion 47 integrally formed therewith which extends vertically in a central portion thereof. The guide protrusion member 46 is formed of the same synthetic resin as the guide protrusion 16. The guide protrusion member 46 has the same height as the hammer guide portion 45, and has a plurality of mounting protrusions (not shown) protruding from an opposite surface thereof to the guide protrusion 47. These plurality of protrusions are fitted into the associated holes of the hammer guide portion 45, respectively, whereby the guide protrusion member 46 is fixed to the hammer guide portion 45. In this state, the respective guide protrusions 47 and 47 of the guide protrusion members 46 and 46 are opposed, respectively, to the respective guide protrusions 16 and 16 of the left and right sidewalls 14 and 14. Further, the protruding length of the guide protrusion 47 from the rib 41 is equal to the protruding length of the guide protrusion 16 from the sidewall 14.

As shown in FIG. 11, the first hammer passage holes 10*a* in the respective B-key row and C-key row are formed between the rib 41 mounted as above and the sidewalls 14 and 14 on the left and right sides thereof. In the B-key row and the C-key row, these sidewalls 14 and the hammer guide portion 45, and the guide protrusions 16 on the respective inner surfaces of the sidewalls 14 and the guide protrusion members 46 (including the guide protrusions 47) on the opposite sides of the hammer guide portion 45 form two guides 17 for respectively restricting the lateral motion of the hammers 4 associated therewith.

Also in each of the chassis 2*b*' for the highest pitch range and the chassis 2*c* for the lowest pitch range, a rib 41 is mounted between a B-key row and a C-key row, and a guide 17 is formed as in the case of the basic chassis 2*a*'.

Further, as shown in FIG. 7, the chassis assembly 2' is provided with a white-key lower limit stopper 21*a*, a black-key lower limit stopper 21*b*, a key upper limit stopper 22, a hammer lower limit stopper 23, and a hammer upper limit stopper 24, for restricting pivotal motions of the keys 3 and the hammers 4. The black-key lower limit stopper 21*b* and the key upper limit stopper 22 are attached to the upper and lower surfaces of the chassis assembly 2', respectively, at the same location between a lateral row of the key passage holes 12 and a lateral row of the associated black key guides 13*b*, such that they sandwich the chassis assembly 2'. The hammer lower limit stopper 23 is attached to the lower end portion of the front connecting bar 6. Further, the white-key lower limit stopper 21*a* and the hammer upper limit stopper 24 are attached to the upper and lower surfaces of the chassis assembly 2', respectively, at a location rearward of a lateral row of the white key guides 13*a* such that they sandwich the chassis assembly 2'. Each of the stoppers 21 to 24 is formed of a belt-like cushioning member extending over the entire length of the chassis assembly 2' in the left-right direction.

Further, at a location rearward of each pair of hammer pivot holes 9, a key switch 25 is provided on the chassis assembly 2', for detecting key-on information of the associated key 3. The key switch 25 is comprised of a printed circuit board 26 fixed to the chassis assembly 2' by screws and a switch body 27 disposed on the top of the printed circuit board 26. The switch body 27 faces the associated third hammer passage hole 10*c* from below, and is connected to a control unit (not shown) for controlling tone generation of the electronic piano, via the printed circuit board 26.

Each of the keys 3 (the white keys 3*a* and the black keys 3*b*) is formed e.g. by an injection molded article of an AS resin, and is comprised of two sidewalls 3*c* (only one of which is shown) and a top wall 3*d*, with an inverted U-shaped cross-section. Each of the sidewalls 3*c* of the key 3 has a rear end thereof formed with a protrusion 31 protruding inward, and the protrusion 31 is fitted into the associated key pivot hole 8 formed in the rear end of the chassis assembly 2', whereby the key 3 is pivotally supported by the chassis assembly 2'. Further, the key 3 is formed with the stopper portions 11 which are hook-shaped and extend downward from the front portions of the two sidewalls 3*c*, respectively.

On the other hand, each hammer 4 is comprised of a hammer body 32 extending in the front-rear direction and two weight plates 33 (only one of which is shown) attached to the respective left and right side surfaces of the front end of the hammer body 32. The hammer body 32 has a rear end thereof formed with pin-shaped protrusions 34 laterally protruding from the respective opposite side surfaces. The protrusions 34 are engaged in the respective adjacent hammer pivot holes 9 formed at the boundary of each adjacent two rows of the chassis assembly 2' such that they span the adjacent two hammer pivot holes 9, whereby the hammer 4 is pivotally supported by the chassis assembly 2'. The weight plates 33, which are provided for adding touch weight similar to that of an acoustic piano to the hammer 4, are formed of a heavy material, such as a steel plate. Further, each weight plate 33 has a rectangular cushioning member 38 attached to a lower portion of a side surface thereof at a location corresponding to the guide protrusion 16 and the guide protrusion member 46. The cushioning member 38 serves to make the weight plate 33 slidable and prevent generation of noise when the weight plate 33 comes into contact with the guide protrusion 16 or the guide protrusion 47.

A portion of the hammer body 32 rearward of the hammer pivot holes 9 forms a switch pressing portion 35. The switch pressing portion 35 is positioned in facing relation to the associated third hammer passage hole 10*c* of the chassis assembly 2', and opposed to the switch body 27 of the key switch 25 from above. An actuator portion 36 formed on the lower surface of the key 3 is in abutment from above with the switch pressing portion 35. Further, the central portion of the hammer 4 passes through the associated second hammer passage hole 10*b* of the chassis assembly 2' in a manner crossing the same from above and extends forward below the chassis assembly 2', and a front end of the hammer 4 is formed with a hammer stopper portion 37 protruding forward.

With the arrangement described above, as a key 3 is depressed, the switch pressing portion 35 of the hammer 4 is pressed by the actuator portion 36 of the key 3 to cause the hammer 4 to pivotally move clockwise, as viewed in FIG. 7, and the weight plates 33 attached to the front end of the hammer 4 move through the first hammer passage hole 10*a* from below. During this operation, the lateral motion of the hammer 4 is restricted by the guide 17. More specifically, the motion is restricted by the sidewalls 14, the hammer guide portion 45, the guide protrusions 16, and the guide protrusion member 46 including the guide protrusion 47.

In accordance with the pivotal motion of the hammer 4, the switch pressing portion 35 depresses the switch body 27 of the key switch 25 to turn on the same. As a result, key-on information of the key 3 is detected, and the tone generation of the electronic piano is controlled based on the result of the detection.

As described above, according to the keyboard device 1' for an electronic piano, according to the present embodiment, it is possible to restrict the lateral motion of the hammer 4 by the guide 17 provided in the front end of the chassis assembly 2'. Therefore, when the electronic piano is placed vertically e.g. for storage, the guide 17 can prevent the hammer 4 from hanging down due to its own weight. Thus, the hammer 4 is supported by the guide 17 without hardly hanging down, and hence bending moment acting on the hammer 4 due to its own weight is reduced, which makes it possible to prevent deformation of the hammer. As a consequence, musical performance on the electronic piano can be carried out without inconvenience. Further, even if the hammer 4 laterally moves out of its proper path of motion during musical performance, the hammer 4 comes into contact with only the guide protrusion 16 semicircular in cross section and extending vertically or the guide protrusion 47, so that an area with which the hammer 4 comes into contact is smaller and hence friction due to contact is also smaller than when the hammer 4 comes into contact with the sidewall 14 or the hammer guide portion 45, which is larger in area than the guide protrusion 16 or 47, which makes it possible to prevent degradation of the touch feeling of the key 3 and generation of noise. In particular, since the steel weight plates 33 of the hammer 4 do not come into contact with the rib 41 formed of a steel plate, generation of metallic sound can be prevented.

Similarly to the guide protrusion 16, the guide protrusion member 46 including the guide protrusion 47 is formed of a synthetic resin, so that the guide the guide protrusion 47 can cooperate with the guide protrusion 16 to guide the hammer 4 in a well-balanced manner and prevent the same from being unevenly worn.

Further, since the rib 41 is disposed such that it extends in the front-rear direction between the B-key row and the C-key row of each chassis at a location where the sidewall 14 is removed, the rigidity of the chassis assembly 2' in the front-rear direction can be reinforced. Therefore, even when a large force is applied to the chassis from a key 3 or a hammer 4, it is possible to prevent distortion of the chassis by the rib 41 which is formed of a steel plate. Furthermore, there is no need to secure new space for mounting the ribs 41, which makes it possible to prevent the size of the keyboard device 1' from being increased.

The rib 41 not only reinforces the rigidity of the chassis, but also cooperates, in place of the removed sidewall 14, with the sidewalls 14 formed on the respective left and right sides thereof, to restrict the lateral motion of the associated hammer 4. Since the rib 41 has both the functions of reinforcing the chassis and serving as a sidewall 14 as described above, the number of component parts can be reduced, which contributes to reduction of the manufacturing costs of the keyboard device 1'.

Further, since the sidewalls 14, the guide-connecting bar 15, and the guide protrusions 16 are integrally formed with the chassis **2*a*', 2*b*' and 2*c*, the operation of mounting these on the chassis 2*a*', 2*b*' and 2*c*, can be dispensed with, which contributes to reduction of the manufacturing costs. Moreover, since each chassis is formed by a synthetic resin molded article, it is possible to easily produce a chassis assembly 2'** having a desired shape and a strength characteristic without undesired variation.

Moreover, since each of the basic chassis **2*a*' is designed to have the rib 41 mounted between the B-key row and the C-key row, it is possible to produce basic chassis 2*a*' each as a unit for an octave, in which the sidewall 14 between the B-key row and C-key row is removed in advance. Therefore, a common mold can be used to produce the basic chassis 2*a*'. Further, the chassis 2*b*' for the highest pitch range and the chassis 2*c* for the lowest pitch range are produced by cutting off the basic chassis 2*a*' along the respective predetermined lines. Therefore, all the chassis 2*a* to 2*c* can be produced using the single common mold, which makes it possible to further reduce the manufacturing costs of the keyboard device 1'**.

It should be noted that the present invention is by no means limited to the embodiments described above, but can be practiced in various ways. For example, although in the first embodiment, the guides 17 are integrally formed with the basic chassis **2*a* and the like, the guides 17 may be formed separately from the basic chassis 2*a* and the like, and then attached to the same. Further, although in the second embodiment, each guide protrusion member 46 is fixed by being fitted in the hammer guide portion 45, an adhesive may be used to fix the same. Further, the material for the guide protrusion member 46 is not limited to a synthetic resin, but may be formed of rubber, for example. Furthermore, it is possible to remove the sidewall 14 and mount the rib 41 at a location other than the location between the B-key row and the C-key row, which is shown by way of example in the second embodiment. For example, it is possible to remove the left and right end sidewalls 14*a/b* and 14*a/b* of the basic chassis 2*a* and mount the ribs 41** at the respective locations. Moreover, although the above-described embodiments are examples of application of the present invention to the electronic piano, this is not limitative, but it goes without saying that the present invention can be applied to electronic musical instruments of other types, such as a synthesizer.

It is further understood by those skilled in the art that the foregoing is a preferred embodiment of the invention, and that various changes and modifications may be made without departing from the spirit and scope thereof.

What is claimed is:

1. A keyboard device for a keyboard instrument, comprising:

a plurality of chassis arranged side by side in a left-right direction;

a plurality of keys pivotally supported by said chassis;

a plurality of hammers pivotally supported by said chassis, for each being pivotally moved in accordance with depression of an associated one of said keys; and a plurality of guides formed in said chassis and each having a pair of left and right sidewalls which are opposed to an associated one of said hammers from opposite sides, for restricting lateral motion of the associated one of said hammers, wherein out of said plurality of guides, one at a boundary of each adjacent two of said chassis has said pair of left and right sidewalls formed by an end sidewall of one of said adjacent two chassis and an end sidewall of the other of said adjacent two chassis.

2. A keyboard device as claimed in claim 1, wherein said guides are integrally formed with said chassis.

3. A keyboard device as claimed in claim 2, wherein said chassis are formed by molded articles of a synthetic resin.

4. A keyboard device as claimed in claim 1, wherein said plurality of chassis include a plurality of chassis which are identical to each other and each provided as a unit for one octave.

5. A keyboard device as claimed in claim 4, wherein said guides are integrally formed with said chassis.

6. A keyboard device as claimed in claim 5, wherein said chassis are formed by molded articles of a synthetic resin.

7. A keyboard device for a keyboard instrument, comprising:

a plurality of chassis arranged side by side in a left-right direction;

a plurality of keys pivotally supported by said chassis;

a plurality of hammers arranged side by side in the left-right direction, and pivotally supported by said chassis, for being pivotally moved in accordance with depression of an associated one of said keys; and a plurality of sidewalls formed in said chassis such that said sidewalls are arranged side by side in the left-right direction at predetermined spaced intervals, each adjacent two of said sidewalls restricting lateral motion of an associated one of said hammers, wherein at least one of said plurality of sidewalls is removed from each of said chassis, and wherein said each chassis has a rib mounted therein such that said rib extends in a front-rear direction through a location where said at least one of said plurality of sidewalls is removed, for reinforcing said each chassis as well as for cooperating with two of said sidewalls located leftward and rightward of said rib to restrict lateral motion of an associated one of said hammers.

8. A keyboard device as claimed in claim 7, wherein said plurality of chassis include a plurality of basic chassis which are identical to each other and each provided as a unit for one octave, and wherein said rib is mounted at a predetermined identical location of each of said plurality of basic chassis.

9. A keyboard device as claimed in claim 7, wherein said chassis are formed by molded articles of a synthetic resin, with which said plurality of sidewalls are integrally formed, and said rib is formed of a metal.

10. A keyboard device as claimed in claim 9, wherein said plurality of chassis include a plurality of basic chassis which are identical to each other and each provided as a unit for one octave, and wherein said ribs are attached, respectively, to said plurality of basic chassis at respective predetermined identical locations.

11. A keyboard device as claimed in claim 9, wherein each of said sidewalls has left and right side surfaces thereof integrally formed with respective guide protrusions extending vertically, and said rib has guide protrusion members attached to left and right side surfaces thereof at respective locations corresponding to said guide protrusions, said guide protrusion members being formed of a synthetic resin and extending vertically.

12. A keyboard device as claimed in claim 11, wherein said plurality of chassis include a plurality of basic chassis which are identical to each other and each provided as a unit for one octave, and wherein said ribs are attached, respectively, to said plurality of basic chassis at respective predetermined identical locations.

* * * * *